US010077549B2

(12) United States Patent
Jensen et al.

(10) Patent No.: US 10,077,549 B2
(45) Date of Patent: Sep. 18, 2018

(54) KITS, ASSEMBLIES AND METHODS FOR NO-TOOLS TOILET INSTALLATION

(71) Applicant: AS IP Holdco, LLC, Piscataway, NJ (US)

(72) Inventors: Robert M. Jensen, East Brunswick, NJ (US); David Grover, Hamilton, NJ (US); James P. Walsh, Bridgewater, NJ (US)

(73) Assignee: AS IP HOLDCO, LLC, Piscataway, NJ (US)

( * ) Notice: Subject to any disclaimer, the term of this patent is extended or adjusted under 35 U.S.C. 154(b) by 46 days.

(21) Appl. No.: 14/869,404

(22) Filed: Sep. 29, 2015

(65) Prior Publication Data

US 2016/0102450 A1 Apr. 14, 2016

Related U.S. Application Data

(63) Continuation of application No. 13/009,841, filed on Jan. 19, 2011, now Pat. No. 9,169,629.

(Continued)

(51) Int. Cl.

| | |
|---|---|
| ***E03D 11/00*** | (2006.01) |
| ***E03D 11/16*** | (2006.01) |
| ***E03D 1/26*** | (2006.01) |

(52) U.S. Cl.

CPC ..... *E03D 11/16* (2013.01); *E03D 1/26* (2013.01); *Y10T 29/49826* (2015.01)

(58) Field of Classification Search

CPC ..... E03D 11/16

(Continued)

(56) References Cited

U.S. PATENT DOCUMENTS

| | | | |
|---|---|---|---|
| 870,085 | A | 11/1907 | Cosgrove |
| 1,149,269 | A | 8/1915 | Klindt |

(Continued)

FOREIGN PATENT DOCUMENTS

| | | | |
|---|---|---|---|
| CN | 102713097 | B | 9/2015 |
| WO | WO 03089724 | A1 | 10/2003 |
| WO | WO 2008/036367 | | 3/2008 |

OTHER PUBLICATIONS

PCT International Search Report, International Application No. PCT/US2011/021778, dated Mar. 23, 2011, 24 pages.

(Continued)

*Primary Examiner* — Huyen Le

(74) *Attorney, Agent, or Firm* — Venable LLP; Michele V. Frank

(57) ABSTRACT

Kits and methods for installing a toilet bowl or toilet assembly without tools, and an installed toilet assembly, are described. The methods and assembly work with an existing flange or can include a standard closet flange configured to receive a flange bolt. The kits and assemblies include a flange bolt having a bolt head and a bolt stem extending from the bolt head and having an end portion opposite the bolt head, wherein the stem has an outer surface and the bolt head is configured so as to fit through an opening in a flange so that the bolt head contacts the lower surface of the flange and the end portion of the stem extends upwardly from the upper surface of the flange; and a bolt locking knob having an interior surface defining an opening extending there-through, wherein the interior surface is configured so that when the end of the bolt stem is placed within the opening the interior surface of the knob contacts the exterior surface of the bolt stem in locking engagement and the knob is able to be hand tightened on the bolt stem when a toilet bowl base is positioned in place over the flange and the bolts have a size that is coordinated with the size of the locking knobs to (Continued)

eliminate the use of tools on installation of the bowl. Handle fasteners for manual tightening may also be included for installation of a tank on the bowl also without the use of tools. Mounting blocks are also described which enable installation while minimizing potential for injury due to suspending a toilet bowl or assembly while aligning the bowl so as to sit on a flange bolt(s).

46 Claims, 8 Drawing Sheets

Related U.S. Application Data

(60) Provisional application No. 61/296,284, filed on Jan. 19, 2010.

(58) Field of Classification Search
USPC ..... 4/252.1, 252.4, 252.5
See application file for complete search history.

(56) References Cited

U.S. PATENT DOCUMENTS 1,670,219 A * 5/1928 Smith ..... E03C 1/0401 285/193
2,236,929 A 4/1941 Tinnerman
2,992,704 A * 7/1961 Showker ..... B64F 1/16 188/32
3,181,585 A 5/1965 Brewington
3,331,496 A 7/1967 Marsden
3,419,298 A 12/1968 Worley
3,669,171 A 6/1972 Yavitch
3,967,326 A 7/1976 Tammen
4,319,365 A 3/1982 Bemis
4,467,481 A 8/1984 Ginsburg
4,530,629 A * 7/1985 Sakow ..... E03D 11/16 285/56
4,574,399 A 3/1986 Sullivan
4,757,560 A 7/1988 Grimstad
4,780,915 A * 11/1988 Cuschera ..... E03D 11/16 4/252.4
4,807,748 A * 2/1989 Manning ..... B65D 19/00 108/156
4,841,880 A 6/1989 Ferguson
4,850,063 A 7/1989 Abbate
4,907,301 A 3/1990 Tucker
4,924,533 A 5/1990 Stairs, Jr.
5,185,890 A 2/1993 Dismore
5,222,851 A 6/1993 Dickerson
D385,761 S * 11/1997 Nave ..... D8/14
5,890,239 A * 4/1999 Hite ..... E03D 11/16 285/56
5,898,954 A 5/1999 Provenzano
6,125,479 A 10/2000 Fraleigh
6,245,141 B1 6/2001 Walker, Jr. et al.
6,254,141 B1 7/2001 Piper
6,615,413 B1 9/2003 Grant
6,644,670 B2 11/2003 Etcheverry
7,004,701 B2 * 2/2006 Ross ..... B25B 13/485 411/405
7,255,316 B1 8/2007 Popadics
7,421,746 B1 9/2008 Cobi
7,490,366 B1 2/2009 Richter
7,950,886 B2 5/2011 Siegal
8,312,608 B2 * 11/2012 Head ..... B62B 3/00 254/10 B
9,169,629 B2 * 10/2015 Jensen ..... E03D 1/26
2003/0052461 A1 3/2003 Ponce
2003/0163864 A1 * 9/2003 Haan ..... E03D 9/08 4/420.4
2004/0016046 A1 1/2004 Siegal
2004/0263035 A1 12/2004 Lim
2005/0184471 A1 8/2005 Ponce
2006/0225191 A1 10/2006 Chen
2007/0186336 A1 * 8/2007 Gately ..... E03D 11/16 4/252.1
2007/0256238 A1 11/2007 Wakil
2007/0266492 A1 11/2007 Junca
2008/0000018 A1 1/2008 Laher
2008/0016606 A1 1/2008 Serret
2008/0066223 A1 3/2008 Halloran
2009/0100581 A1 4/2009 Mixon
2009/0238658 A1 9/2009 Conrad
2015/0368891 A1 12/2015 Miller
2016/0102450 A1 4/2016 Jensen et al.

OTHER PUBLICATIONS

PCT International Preliminary Report on Patentability, International Application No. PCT/US2011/021778, dated Jul. 24, 2012, 21 pages.
Chinese Office Action, Chinese Application No. 201180006108.6, dated Sep. 23, 2013, 23 pages.
Response to Chinese Office Action, Chinese Application No. 201180006108.6, dated May 17, 2014, 29 pages.
Second Chinese Office Action, Chinese Application No. 201180006108.6, dated Jun. 16, 2014, 23 pages.
Response to Second Chinese Office Action, Chinese Application No. 201180006108.6, dated Aug. 29, 2014, 27 pages.
Third Chinese Office Action, Chinese Application No. 201180006108.6, dated Dec. 5, 2014, 7 pages.
Response to Third Chinese Office Action, Chinese Application No. 201180006108.6, dated Feb. 16, 2015, 27 pages.
Dominican Republic Office Action, Dominican Application No. P2012-0201, dated Mar. 3, 2014, 2 pages.
Response to Dominican Republic Office Action, Dominican Application No. P2012-0201, dated Jul. 23, 2014, 9 pages.
Second Dominican Republic Office Action, Dominican Application No. P2012-0201, dated Aug. 26, 2015, 3 pages.
Mexican Office Action, Mexican Application No. MX/a/2012/008329, dated Sep. 1, 2014, 8 pages.
Response to Mexican Office Action, Mexican Application No. MX/a/2012/008329, dated Jan. 15, 2015, 28 pages.
Second Mexican Office Action, Mexican Application No. MX/a/2012/008329, dated Apr. 15, 2015, 6 pages.
Response to second Mexican Office Action, Mexican Application No. MX/a/2012/008329, dated Aug. 27, 2015, 19 pages.
United Kingdom Examination Report, U.K. Application No. GB1211880.8, dated Mar. 19, 2015, 3 pages.
Response to United Kingdom Examination Report dated Jul. 17, 2015, 4 pages.
Second United Kingdom Examination Report, United Kingdom Application No. GB1211880.8, dated Aug. 4, 2015, 3 pages.
Response to United Kingdom Examination Report dated Dec. 4, 2015 in Application No. 1211880.8 (counterpart of U.S. Appl. No. 14/869,404) (13 pages).
United Kingdom Search Report dated Mar. 9, 2016 in Application No. GB1522604.6 (counterpart of U.S. Appl. No. 14/869,404) (6 pages).
Response to United Kingdom Search Report dated Apr. 26, 2016 in Application No. GB1522604.6 (10 pages).
United Kingdom Notice of Grant in Application No. GB1522604.6 dated Jul. 5, 2016 (2 pages).
United Kingdom Search Report dated Mar. 30, 2016 in Application No. GB1522605.3 (5 pages).
Response to United Kingdom Search Report dated Apr. 26, 2016 in Application No. GB1522605.3 (10 pages).
United Kingdom Notice of Grant in Application No. GB1522605.3 dated Jun. 21, 2016 (2 pages).
Canadian Office Action dated Jun. 29, 2016 in Application No. 2787166 (counterpart of U.S. Appl. No. 14/869,404) (4 pages).
Response to Canadian Office Action dated Dec. 9, 2016 in Application No. 2787166 (counterpart of U.S. Appl. No. 14/869,404) (19 pages).
Second Canadian Office Action dated Mar. 6, 2017 in Application No. 2787166 (counterpart of U.S. Appl. No. 14/869,404) (3 pages).

(56) References Cited

OTHER PUBLICATIONS

First Chinese Office Action dated Jul. 25, 2016 in Chinese Divisional Application No. 2015104905055 (counterpart of U.S. Appl. No. 14/869,404) and English Translation (27 pages).
Response to First Chinese Office Action dated Feb. 9, 2017 in Chinese Application No. 2015104905055 (counterpart of U.S. Appl. No. 14/869,404) (English Translation) (32 pages).
Response to Second Dominican Office Action dated Dec. 14, 2015 in Application No. P2012-0201 (counterpart of U.S. Appl. No. 14/869,404) and English translation (13 pages).
Third Dominican Office Action dated Apr. 15, 2016 in Application No. P2012-0201 (English translation) (counterpart of U.S. Appl. No. 14/869,404) (5 pages).
Response to Third Dominican Office Action in Application No. P2012-0201 dated Nov. 29, 2016 (counterpart of U.S. Appl. No. 14/869,404) (5 pages).
Response to Mexican Office Action dated Aug. 27, 2015 in Application No. MX/a/2012/008329 and English translation (counterpart of U.S. Appl. No. 14/869,404)(35 pages).
Mexican Notice of Allowance dated Feb. 26, 2016 in Application No. MX/a/2012/008329 (counterpart of U.S. Appl. No. 14/869,404) (1 page).
Canadian Office Action issued in corresponding Canadian Application No. 2,787,166 dated Mar. 6, 2017.
Second Office Action issued in corresponding Chinese Application No. 2015104905055 dated Mar. 13, 2017 (with English translation).

* cited by examiner

KITS, ASSEMBLIES AND METHODS FOR NO-TOOLS TOILET INSTALLATION

CROSS-REFERENCE TO RELATED APPLICATIONS

This application is a continuation application of and claims priority under 35 U.S.C. § 120 to U.S. patent application Ser. No. 13/009,841, filed Jan. 19, 2011, entitled, "Kits, Assemblies and Methods For No-Tools Toilet Installation," which claims the benefit under 35 U.S.C. § 119(e) of U.S. Provisional Patent Application No. 61/296,284, filed Jan. 19, 2010, entitled "Kits, Assemblies and Methods for No-Tools Toilet Installations," the entire disclosures of which are incorporated herein by reference.

BACKGROUND OF THE INVENTION

Field of the Invention

The invention is related to the field of installation and mounting of plumbing fixtures, more particularly to the installation of toilet bowls, toilets having a bowl and tank, commodes or water closets, referred to herein as "toilets" or "toilet assemblies."

Description of Related Art

Installations of a toilet assembly (a toilet including a bowl portion and a tank portion) according to a typical prior art method includes positioning mounting bolts (generally T-bolts) through slots in a closet flange that is designed to be aligned and spaced with respect to the wall behind the toilet to be installed. The bolts fit into slots in the closet flange so that the head of the bolt is on the floor and the stem of the bolt is positioned upright. The bowl portion of the toilet, or an entire toilet system in the case of a one-piece toilet, is then lowered so that installation bolt holes pre-formed in the base of the bowl portion of the toilet are aligned with the flange T-bolts with the purpose of slipping the bolts through the mounting bolt holes typically preformed in the toilet base.

Generally, a single person (or perhaps two people in the event of a homeowner installation) holds the toilet bowl portion or a complete one-piece toilet having a bowl portion over the bolts and lowers the toilet bowl, which is a problem if the bolts move as the bowl and/or toilet is quite heavy. This causes repositioning and sometimes the need to straighten or realign the bolts. It also typically causes the person(s) installing the bowl and/or one-piece toilet to hold the toilet suspended (hovering) over the bolts while manipulating the position of the bowl so that the T-bolts can slide into the mounting holes. In some cases, one person may be positioning the T-bolts while the other person(s) are suspending the bowl. These method(s) of installation present opportunities for injury either to hands and fingers of a person steadying the T-bolts and/or to the back, shoulders or other musculoskeletal areas of the person who is forced to suspend the toilet over the T-bolts while positioning the mounting holes over the bolts (particularly where the bolts move).

After the bowl (having been prepared with a wax seal) is finally seated on the floor so that the bolts extend upright properly through the mounting bolt holes. The bolts are tightened in place on the bowl base by using a wrench or pliers on the bolt after hand-tightening a multi-component assembly generally including a bolt cap base piece/gasket, a washer, and a nut. The bolts are then cut to size, generally using bolt cutters and/or a hack saw. This is because the closet flange, which is typically already placed on the floor prior to installation of a new toilet bowl, may be located above or below floor level, to make up for the uncertainty regarding where the flange will sit. Thus, most toilet bolts are made to be sufficiently long to allow for various installation placements of the flange. In addition, longer flange bolts are typically also used because it is easier to place the bowl by guiding the bolts through the mounting holes if the bolts are longer and can accommodate some movement of the bowl during installation. Thus, flange bolts offered for installation presently are of a standard size that is expected to work for various types of installations and placements of the closet flange on the mounting surface. The thought being that if they are longer than needed, they may be cut to size, but if they are too short, they may make installation difficult or impossible. After the bolts are cut to size, the installer places a cap over the bolts. Sometimes the cap does not fit well over the bolt, requiring further bolt cutting, tightening and adjustment.

In the case of a two-piece toilet assembly, after the bowl portion is in place, the tank is positioned over the pre-drilled holes in the rear of the top surface of the bowl portion. The tank has a rubber gasket pre-positioned over the spud extending downward through a lower portion of the tank, and has bolts installed thereon that also extend downwardly from the tank. Such bolts typically fit loosely through the holes in the bottom of the tank while the rubber gasket holds the tank somewhat in place until further mounting is completed. The downward extending ends of the tank bolts are lowered through the tank mounting bolt holes in the bowl portion, and the rubber gasket is aligned to fit in the spud hole in the bowl as well which forms a primary waterway from the tank to the bowl. The holes in the tank are formed by molding and/or are pre-cut before firing in the same manner as the mounting holes in the bottom of the toilet bowl. A multiple component assembly is used with a wrench to tighten the tank bolts after they pass through the bottom of the holes formed at the rear of the upper surface of the toilet bowl. The assembly includes a washer, a nut and sometimes a gasket that together secure the end of the tank bolt head to connect the rear portion of the bowl of the toilet assembly to the tank. The tank is checked to see if it is level and additional wrench adjustment may be necessary until the tank is level.

While professional installers such as plumbers would typically have all the correct tools needed for installation, and are experienced in terms of how to handle a toilet bowl while positioning the bowl, problems arise for homeowners and other non-professional installers that may not have the correct tools and instead use improper tools and/or have difficulty installing without the proper tools. In a typical installation method, there are difficulties in that the closet flange bolts tend to move. Tools such as wrenches, pliers, bolt cutters and saws are necessary and typically have to be used in very small, tight areas with little room for manipulation. Even for a professional who has the correct tools, the process can be time-consuming and the small areas available for installation challenging. In all cases, there is also the opportunity for user injury from lifting the toilet bowl and holding it for too long a period of time, to hands, fingers or other body parts of those involved with the installation while positioning the bowl as well as injuries from close-quarters installation or improper use of tools.

The toilet bowl is heavy so that if the closet bolts move, the person holding the bowl portion has to lift the toilet bowl more than once and/or suspend the bowl over the bolts while someone adjusts them and/or realign the bolts while positioning the bowl so that they stand up straight through the holes. It is possible that people, typically non-professionals, can be injured during the installation while holding and/or positioning the bolts in the mounting holes. Similarly, when non-professionals are installing the bowl, the bowl may be dropped or accidentally placed on the installer's fingers while positioning the bolts. Back-lifting injuries are more likely the more the installer has to hold the tank up while positioning or repositioning the bowl. Use of tools such as wrenches, saws, pliers and bolt cutters in small areas, particularly improper tools, can also increase the risk of installer injury particularly when used by non-professionals.

The typical installation method set forth above is a difficult and a time-consuming process which often requires a professional plumber, since it is difficult for many homeowners to do themselves. Even if a professional plumber handles the installation, it can take considerable time, generally over a half hour for an experienced professional and sometimes longer depending on the difficulties encountered in the installation.

Attempts in the art have been made to improve one or more aspects of the process. For example, U.S. Publication No. 2007/0186336 A1 teaches providing a closet flange with closet bolts permanently fixed to a closet flange such as by molding or some other process and screw-on caps that fit the closet bolts to avoid use of a multi-component assembly on the toilet base.

Bolt retainers to try to keep the closet mounting bolts in place while positioning the toilet are also known. See for example, U.S. Publication No. 2004/0016046A1 and U.S. Pat. No. 6,125,479.

While some improvements have been attempted, bolt cutting, difficult tool use in installation, the requirement for specialized tools and expertise and long installation times still exist. There is a need in the art to improve the overall process of toilet installation to make it easier for homeowners and non-professionals to do, to minimize the risk of injury in installation and the failure to successfully install the bowl, as well as to reduce the overall time involved in toilet installation.

BRIEF SUMMARY OF THE INVENTION

The invention includes assemblies for installing toilet bowls and toilet bowl assemblies, kits and methods for installing toilet bowls and toilet bowl assemblies as well as installed toilet bowls and assemblies, wherein installation is possible and/or can be completed without the use of tools, is made more rapid and also can help reduce the risk of injury associated with prolonged toilet bowl positioning and repositioning and/or with tool use. It also includes a method for installation of a toilet that minimizes potential back injuries limiting the amount of time that an installer has to suspend a toilet over the flange bolts whether using the kits, assemblies and methods herein as well as by including in such methods, kits and/or assemblies mounting block(s) for aiding the person installing the toilet bowl or bowl assembly. Such mounting block(s) may also be used without the kits or assemblies of the invention to improve prior art methods of installation using traditional installation kits and assemblies.

In one embodiment hereof, a novel assembly for installing a toilet bowl is provided that comprises: (a) a flange having an upper surface, a lower surface and an opening extending from the upper surface to the lower surface that is configured to receive a flange bolt; (b) a flange bolt having a bolt head and a bolt stem extending from the bolt head and having an end portion opposite the bolt head, wherein the stem has a length measured longitudinally along the stem and an outer surface and the bolt head is configured so as to fit through the opening in the flange so that the bolt head contacts the lower surface of the flange and the end portion of the stem extends upwardly from the upper surface of the flange; and (c) a bolt locking knob having an interior surface defining an opening extending through the knob, wherein the interior surface is configured so that upon installation of the toilet bowl, when the end of the bolt stem is placed within the opening in the bolt locking knob, the interior surface of the knob contacts the exterior surface of the bolt stem in locking engagement and the knob is able to be hand tightened on the bolt stem, wherein the length of the bolt stem is pre-sized so that the end portion of the stem of the flange bolt is substantially within the opening in the bolt locking knob.

The bolt locking knob in the above assembly may be optionally made to have a downwardly extending portion and the opening through the locking knob would extend through the knob and the downwardly extending portion. Such an assembly may optionally comprises a flange nut configured to fit over the end of the bolt stem and over the stem so that at least a portion of the flange nut contacts the upper surface of the flange and is stably locked against the bolt stem. If a flange nut is provided, it may be generally planar having an upper surface and a lower surface and having an opening therethrough, wherein the opening fits over the end of the bolt head, and may further comprise a bent portion on either side of the opening of the flange nut that bends outwardly and upwardly from the upper surface of the flange nut so that the bent portions of the flange nut engage the outer surface of the stem. The flange nut may include metal, polymer material, reinforced polymer material, composite material or combinations thereof.

A cover configured to be placed over the bolt locking knob may also optionally be included in the above-noted assembly. The flange may also have two openings and the assembly may accordingly comprise two flange bolts. The opening(s) in the flange are preferably configured so as to have a first portion sized to receive the bolt head and a slot-like portion for adjusting the flange bolt position after the bolt head is passed through the first portion of the opening. The bolt head preferably is generally planar and has a generally rectangular peripheral shape. The flange may be any suitable flange including those which comprise an insert portion that extends downwardly from the center of the flange for insertion into a drain conduit. Further, in the assembly, it is preferred that the bolt locking knob has an outer periphery shaped to facilitate manual tightening of the knob. In a further preferred embodiment of the above-noted assembly, at least a portion of the stem of the flange bolt is threaded and the interior surface of the bolt locking knob is threaded so that the outer surface of the flange bolt is configured for locking engagement with the interior surface of the locking knob through mating threads. The assembly may also include one or more mounting blocks, and preferably two such mounting blocks.

The invention further includes a kit for installing a toilet bowl comprising: (a) a flange bolt having a bolt head and a bolt stem extending from the bolt head and having an end portion opposite the bolt head, wherein the stem has a length measured longitudinally along the stem and an outer surface and the bolt head is configured so that upon installation it will fit through an opening in a closet flange so that the bolt head contacts a lower surface of a closet flange and the end portion of the stem extends upwardly from an upper surface of a closet flange; (b) a bolt locking knob having an interior surface defining an opening extending through the knob, wherein the interior surface of the bolt locking knob is configured so that upon installation of the toilet bowl, when the end of the bolt stem is placed within the opening in the bolt locking knob, the interior surface of the knob contacts the exterior surface of the bolt stem in locking engagement and the knob is able to be hand tightened on the bolt stem, wherein the length of the bolt stem is pre-sized so that the end portion of the stem of the flange bolt is substantially within the opening in the bolt locking knob; and (c) instructions for installing a bowl.

In the above-noted kit, the instructions preferably describe a tool-free installation of the toilet bowl. While the kit may be used to install a toilet bowl on an existing floor-mounted flange, the kit may optionally include a flange having an upper surface, a lower surface and an opening extending from the upper surface to the lower surface that is configured to receive a flange bolt. In the kit, also the bolt locking knob may be optionally made to have a downwardly extending portion and the opening through the locking knob would extend through the knob and the downwardly extending portion. The kit may further include an optional flange nut configured to fit over the end of the bolt stem and over the stem so that upon installation at least a portion of the flange nut will contact an upper surface of a closet flange and be stably locked against the bolt stem. A cover configured to be placed over the bolt locking knob may also be included in the kit.

In a further embodiment of the kit noted above, the kit may include at least one optional mounting block, wherein the mounting block is configured so as to suspend a portion of a toilet bowl above a mounting surface for ensuring placement of a flange bolt through a mounting hole on a toilet bowl to be installed. In a preferred embodiment, there are two such mounting blocks, wherein one mounting block is configured so as to suspend a bottom surface of a toilet bowl in a front portion thereof above a mounting surface and another mounting block is configured so as to suspend the bottom surface of the toilet bowl in a rear portion thereof above the mounting surface. The mounting block(s) preferably each have a length measured longitudinally along the block which is the same or greater than a width of a toilet bowl to be installed using the kit as measured transversely across a toilet bowl. The mounting block(s) comprise a material of sufficient strength to suspend a toilet bowl during installation for ensuring placement of a flange bolt through a mounting hole on the toilet bowl to be installed, preferably one which will not mar the mounting surface, such as a floor, on which the toilet bowl is being mounted. Preferably, the mounting block(s) comprise at least one material selected from the group consisting of wood, oriented strand board, medium density fiberboard, metal, foam, polymeric materials, and composite materials. A pull tab(s) may be provided for facilitating removal of the mounting block(s).

The invention further includes an assembly for installing a two-piece toilet assembly wherein the toilet assembly includes a bowl portion and a separate tank portion, comprising: (a) a flange having an upper surface, a lower surface and an opening extending from the upper surface to the lower surface that is configured to receive a flange bolt; (b) a flange bolt having a bolt head and a bolt stem extending from the bolt head and having an end portion opposite the bolt head, wherein the stem has a length measured longitudinally along the stem and an outer surface and the bolt head is configured so that upon installation of a bowl portion of a two-piece toilet assembly, the bolt head will fit through the opening in the flange so that the bolt head contacts the lower surface of the flange and the end portion of the stem extends upwardly from the upper surface of the flange; (c) a bolt locking knob having an interior surface defining an opening extending through the knob, wherein the interior surface is configured so that upon installation of a bowl portion of a two-piece toilet assembly, when the end of the bolt stem is placed within the opening of the bolt locking knob, the interior surface of the knob contacts the exterior surface of the bolt stem in locking engagement and the knob is able to be hand tightened on the bolt stem, wherein the length of the bolt stem is pre-sized so that the end portion of the stem of the flange bolt is substantially within the opening in the bolt locking knob; and (c) a handle fastener having an interior surface defining an opening therein configured to receive a tank locking bolt for fastening a toilet tank to a toilet bowl in a toilet assembly in locking engagement, the handle fastener having an outer surface configured for manual tightening.

In the assembly noted above, the bolt locking knob may further comprise a downwardly extending portion and the opening in the locking knob may further be extended within the opening in the bolt locking knob. The assembly may also include an optional flange nut configured to fit over the end of the bolt stem and over the stem so that at least a portion of the flange nut contacts the upper surface of the flange and is stably locked against the bolt stem. If so, the flange nut may be generally planar having an upper surface and a lower surface and having an opening therethrough, wherein the opening fits over the end of the bolt head, and further comprises a bent portion on either side of the opening of the flange nut that bends outwardly and upwardly from the upper surface of the flange nut so that the bent portions of the flange nut engage the outer surface of the stem. Further, the flange nut may include metal, polymer material, reinforced polymer material, composite material or combinations thereof. An optional cover configured to be placed over the bolt locking knob may also be included in the assembly. The assembly flange may have two openings and the assembly also comprises two flange bolts. In one preferred embodiment, the bolt locking knob has an outer periphery shaped to facilitate manual tightening of the knob. At least a portion of the stem of the flange bolt in the assembly is preferably threaded and the interior surface of the bolt locking knob is also preferably threaded so that the outer surface of the flange bolt is configured for locking engagement with the interior surface of the locking knob through mating threads.

In a further embodiment of the assembly noted above, the assembly may comprise at least one, and preferably two mounting blocks. The mounting block(s) are configured for suspending a portion of a toilet bowl above a mounting surface for ensuring placement of a flange bolt through a mounting hole on a toilet bowl to be installed. When two mounting blocks are used, one mounting block is configured for suspending a lower or bottom surface of a toilet bowl in a front portion thereof above a mounting surface and another mounting block is configured for suspending the bottom surface of the toilet bowl in a rear portion thereof above the mounting surface.

The invention also includes a kit for installing a two-piece toilet assembly wherein the toilet assembly includes a bowl portion and a separate tank portion, comprising: (a) a flange bolt having a bolt head and a bolt stem extending from the bolt head and having an end portion opposite the bolt head, wherein the stem has a length measured longitudinally along the stem and an outer surface and the bolt head is configured so that upon installation of a bowl portion of a two-piece toilet assembly, the bolt head will fit through the opening in a closet flange so that the bolt head contacts a lower surface of a closet flange and the end portion of the stem extends upwardly from an upper surface of a closet flange; (b) a bolt locking knob having an interior surface defining an opening extending through the knob, wherein the interior surface is configured so that upon installation of a bowl portion of a two-piece toilet assembly, when the end of the bolt stem is placed within the opening of the bolt locking knob, the interior surface of the knob contacts the exterior surface of the bolt stem in locking engagement and the knob is able to be hand tightened on the bolt stem, wherein the length of the bolt stem is pre-sized so that the end portion of the stem of the flange bolt is substantially within the opening in the bolt locking knob; (c) a handle fastener having an interior surface defining an opening therein configured to receive a tank locking bolt for fastening a toilet tank to a toilet bowl in a toilet assembly in locking engagement, the handle fastener having an outer surface configured for manual tightening; and (d) instructions for installing a two-piece toilet assembly having a toilet bowl and a toilet tank.

In the above-noted kit for installing a two-piece toilet assembly, the instructions preferably describe a tool-free installation of the toilet assembly. The bolt locking knob may include a downwardly extending portion and the opening in the bolt locking knob may extend through the knob. A cover configured to be placed over the bolt locking knob may also be provided to the kit. While existing floor-mounted flanges may be used in conjunction with the kit, the kit may optionally include a flange having an upper surface, a lower surface and an opening extending from the upper surface to the lower surface that is configured to receive a flange bolt. If a flange is provided, it may have two openings and the kit may further comprise two flange bolts. Further, the opening in the flange has a first portion sized to receive the bolt head and a slot-like portion for adjusting the flange bolt position after the bolt head is passed through the first portion of the opening. The bolt head is preferably generally planar and has a generally rectangular peripheral shape. The kit may also include an optional flange nut configured to fit over the end of the bolt stem and over the stem so that upon installation at least a portion of the flange nut will contact an upper surface of a closet flange and be stably locked against the bolt stem. Such a flange nut may be generally planar having an upper surface and a lower surface and having an opening therethrough, wherein the opening fits over the end of the bolt head, and further comprises a bent portion on either side of the opening of the flange nut that bends outwardly and upwardly from the upper surface of the flange nut so that the bent portions of the flange nut engage the outer surface of the stem. In the kit, the bolt locking knob also preferably has an outer periphery shaped to facilitate manual tightening of the knob. At least a portion of the stem of the flange bolt is preferably threaded and the interior surface of the bolt locking knob is also preferably threaded so that the outer surface of the flange bolt is configured for locking engagement with the interior surface of the locking knob through mating threads. The interior surface of the handle fastener is also preferably threaded for mating threaded engagement with threads on an exterior surface of a tank locking bolt. Preferably, at least two handle fasteners are provided to the kit for receiving at least two tank locking bolts, and in some embodiments three handle fasteners and three bolts can be provided. The outer surface of the handle fastener preferably has a surface to facilitate gripping for manual tightening. The handle fastener may be a one-piece or two-piece fastener, the latter having a detachable handle portion.

In another embodiment of the kit noted above for installing a two-piece toilet assembly, the kit may optionally comprise at least one mounting block, wherein the mounting block is configured so as to suspend a portion of a toilet bowl above a mounting surface for ensuring placement of a flange bolt through a mounting hole on a toilet bowl to be installed.

The invention further includes a method for installing a toilet bowl without using tools, comprising: (a) providing a flange bolt comprising a bolt head and a bolt stem extending from the bolt head and having an end portion opposite the bolt head, wherein the stem has a length measured longitudinally along the stem and an outer surface; (b) inserting a flange bolt through an opening in a flange, wherein the flange comprises an upper surface, a lower surface and the opening, wherein the opening extends from the upper surface to the lower surface and is configured to receive a flange bolt, so that the bolt head fits through the opening in the flange, the bolt head contacts the lower surface of the flange and the end portion of the stem extends upwardly from the upper surface of the flange; (c) placing a toilet bowl having a mounting hole extending through a base thereof over the stem of the flange bolt so that the end portion of the stem extends upwardly through the mounting hole; (d) placing a bolt locking knob over the end portion of the flange bolt stem, wherein the bolt locking knob has an interior surface defining an opening extending through the locking knob and the interior portion thereof, wherein the bolt locking knob is placed so that when the end portion of the bolt stem is within the opening of the bolt locking knob, the interior surface of the bolt locking knob contacts the exterior surface of the bolt stem in locking engagement and wherein the length of the bolt stem is pre-sized so that upon placement of a toilet bowl over the flange bolt and placement of the bolt locking knob over the end portion of the flange bolt stem, the end portion of the flange bolt stem is substantially within the opening of the bolt locking knob; and (e) manually tightening the knob on the bolt stem.

In the method, the bolt lock knob may include a downwardly extending portion, with the opening in the bolt locking knob also extending through the downwardly extending portion, and the bolt locking knob is placed so that the downwardly extending portion of the bolt locking knob extends into the mounting hole in the base of the toilet bowl. The method preferably comprises positioning an optional flange nut over the bolt stem and over the stem so that at least a portion of the flange nut contacts the upper surface of the flange and is stably locked against the bolt stem prior to placing the toilet bowl. If such a flange nut is used, it is preferably generally planar having an upper surface and a lower surface and having an opening therethrough, wherein the opening fits over the end of the bolt head, and further comprises a bent portion on either side of the opening of the flange nut that bends outwardly and upwardly from the upper surface of the flange nut, and the method further comprises positioning the flange nut by sliding it over the bolt stem until the lower surface of the flange nut at least partially contacts the upper surface of the flange and the bent portions of the flange nut engage the outer surface of the bolt stem. The method may also include placing a cover over the bolt locking knob. Two flange bolts may be inserted through two openings in the flange, and a toilet bowl having two mounting holes extending through a base thereof may be then provided over the stems of the two flange bolts so that the end portions of the flange bolt stems extend upwardly through the mounting holes. The opening in the flange preferably has a first portion sized to receive the bolt head and a slot-like portion, in which case, the method may further comprise adjusting the flange bolt position after the bolt head is passed through the first portion of the opening by sliding the flange bolt in the slot-like portion.

The bolt locking knob used in the method preferably has an outer periphery shaped to facilitate manual tightening of the knob. At least a portion of the stem of the flange bolt in the method is preferably threaded and the interior surface of the bolt locking knob preferably has mating threads, in which case, the method may further comprise placing the bolt locking knob over the end of the flange bolt stem, and engaging the mating threads of the bolt locking knob with the threaded portion of the flange bolt so that the bolt locking knob contacts the exterior surface of the bolt stem in locking engagement by way of the mating threads.

In a further embodiment of the method noted above, the method may comprise before step (c) of placing the toilet bowl over the stem of the flange bolt, positioning at least one mounting block on the mounting surface so that when the toilet bowl is placed over the end of the bolt, the toilet bowl is at least partially suspended over the mounting surface for better placement of the bolt in the mounting hole of the toilet bowl, and after step (c) of placing the stem in the mounting hole, the method may further comprise removing the at least one mounting block. In a preferred embodiment, two such mounting blocks would be positioned on the mounting surface, wherein one mounting block would be positioned so as to be under a rear portion of a lower or bottom surface of the toilet bowl and the other mounting block would be positioned so as to be under a front portion of the lower surface of the toilet bowl, so that when the toilet bowl is placed over the end of the flange bolt, the toilet bowl is suspended over the mounting surface for better placement of the bolt(s) in the mounting hole(s) of the toilet bowl.

In one embodiment, the method may also include installing a tank over the toilet bowl, by providing a handle fastener having an interior surface defining an opening in the handle fastener, and an outer surface configured for manual tightening of the handle fastener; placing a toilet tank having a tank bolt having an end extending downwardly therefrom over the toilet bowl so that the tank bolt extends downwardly through a tank mounting hole in a rear portion of an upper surface of the toilet bowl and the end of the tank bolt extends beyond the tank mounting hole; inserting the end of the tank bolt in the opening of the handle fastener; and manually tightening the handle fastener on the tank bolt. In the method, there may also be two or more such handle fasteners for receiving two or more tank locking bolts, wherein the method may further comprises manually tightening the two or more handle fasteners on the two or more tank bolts. The interior surface of the handle fastener in the method is preferably threaded and the method may thus further comprise manually tightening the handle fastener by engaging the threaded interior surface of the handle fastener with threads on an outer surface of the toilet bolt. The handle fastener may have a detachable handle portion and the method further comprise detaching the handle portion. The method may also further comprise installing a toilet seat on the toilet bowl, wherein the toilet bowl preferably has toilet seat mounting bolts installed thereon for receiving the toilet seat prior to placing the toilet bowl on the flange, and more preferably wherein the toilet seat is one capable of manually attaching to the toilet seat mounting bolts without use of tools.

The invention also includes an installed toilet assembly wherein the toilet assembly includes a bowl portion and a separate tank portion, comprising: a flange having an upper surface, a lower surface and an opening extending from the upper surface to the lower surface that is configured to receive a flange bolt, the lower surface of the flange contacting an installation surface; a toilet bowl having a mounting hole extending through a base thereof and an upper surface having a rear portion having a tank mounting hole extending therethrough; a flange bolt having a bolt head and a bolt stem extending from the bolt head and having an end portion opposite the bolt head, wherein the stem has a length measured longitudinally along the stem and an outer surface and the bolt head fits through the opening in the flange so that the bolt head contacts the lower surface of the flange and the end portion of the stem extends upwardly from an upper surface of a closet flange; and a bolt locking knob having an interior surface defining an opening extending through the knob, wherein the end of the bolt stem is within the opening of the bolt locking knob, the interior surface of the knob contacts the exterior surface of the bolt stem in locking engagement and the knob is hand tightened on the bolt stem, wherein the length of the bolt stem is pre-sized and the end portion of the stem of the flange bolt is substantially within the opening in the bolt locking knob.

The bolt locking knob in the above-noted assembly may also include a downwardly extending portion that extends downwardly into the mounting hole in the base of the toilet bowl in the assembly, wherein the opening in the bolt locking knob extends also through the downwardly extending portion of the bolt locking knob. The assembly may also comprise a flange nut configured to fit over the end of the bolt stem and over the stem, wherein at least a portion of the flange nut contacts the upper surface of the flange and is stably locked against the bolt stem.

A toilet tank may be provided to the installed toilet assembly which is positioned on the rear of the upper surface of the toilet bowl and has a toilet tank locking bolt having a lower end, the toilet tank locking bolt extending downwardly from a bottom surface of the toilet tank so that the lower end thereof extends through the tank mounting hole in the toilet bowl, and a handle fastener having an interior surface defining an opening therein configured to receive the end of the tank locking bolt, wherein the handle fastener is manually fastened on the end of the tank locking bolt in locking engagement, and the handle fastener has an outer surface configured for manual tightening. Preferably, the installed toilet assembly has two flange openings, two flange bolts, two mounting holes in the base of the toilet bowl and two or more tank mounting holes in the rear of the upper surface of the toilet bowl, two or more tank locking bolts in the toilet tank, and two or more handle fasteners. The toilet tank may be made to be sealingly installed on the toilet bowl. A wax seal may also be provided on a lower surface of the toilet bowl and compressed between the upper surface of the flange and the lower surface of the toilet bowl. The installed assembly may include a cover placed on the base of the toilet bowl over the bolt locking knob.

Also within the invention is a method for installing a toilet bowl on a mounting surface, comprising: (a) providing a flange bolt comprising a bolt head and a bolt stem extending from the bolt head and having an end portion opposite the bolt head, wherein the stem has a length measured longitudinally along the stem and an outer surface; (b) inserting the flange bolt through an opening in a flange, wherein the flange comprises an upper surface, a lower surface and the opening, wherein the opening extends from the upper surface to the lower surface and is configured to receive a flange bolt, so that the bolt head fits through the opening in the flange, and the end portion of the stem extends upwardly from the upper surface of the flange and positioning the flange on the mounting surface; (c) positioning a mounting block on the mounting surface; (d) placing a toilet bowl having a mounting hole extending through a base thereof so as to be near or over the stem of the flange bolt and lowering the toilet bowl until at least a portion of a lower surface of the toilet bowl rests on the mounting block; (e) ensuring that the stem of the flange bolt is within the mounting hole and upright; and (f) removing the mounting block.

Step (c) of this method may further comprise positioning another mounting block on the mounting surface, wherein each of said mounting blocks is positioned so as to lie beneath a front and a rear portion of the lower surface of the toilet bowl when the toilet bowl is placed so as to be near or over the stem in step (d). Step (e) may further comprise moving the toilet bowl on the blocks until the stem of the flange bolt is within the mounting hole and upright. The mounting block may also optionally comprise a pull tab(s), and step (f) may then further comprise removing the mounting block by pulling the pull tab while lifting the toilet bowl.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

Figure 16:
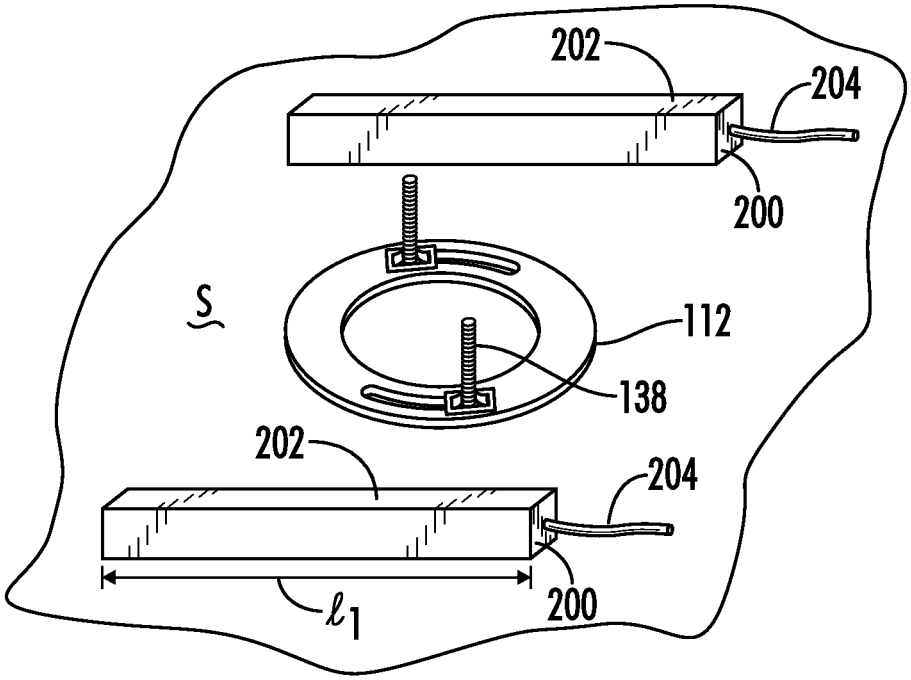
Figure 17:
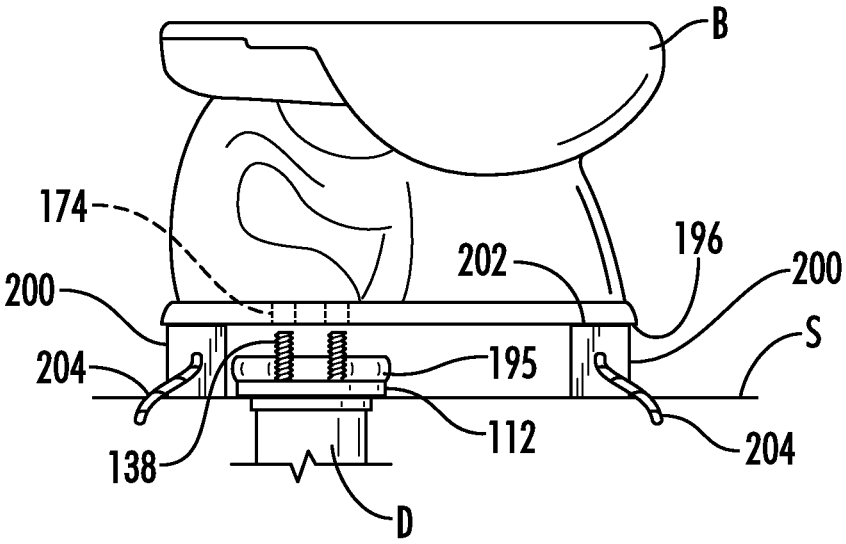

FIG. 16 is a perspective view of the positioning of two mounting blocks for use in an embodiment of a method for installing a toilet bowl or toilet bowl assembly herein on a mounting surface near a toilet installation flange; and FIG. 17 is a side elevational view of a toilet bowl being installed according to a preferred embodiment herein having a bottom or lower surface resting on two mounting blocks on a mounting surface prior to positioning mounting bolts in mounting holes on the toilet bowl.

DETAILED DESCRIPTION OF THE INVENTION

The invention includes kits and methods for installing toilet bowls and toilet assemblies without the ordinary required use of tools. It also includes an installed toilet bowl and toilet bowl assembly. As used herein, use of tools indicates use of bolt cutters and/or saws such as hand saws for cutting toilet flange mounting bolts, use of wrenches, pliers, ratchets and the like for tightening multi-component bolt and nut assemblies, and/or use of any other external tools other than a user's hands to install. It does not necessarily exclude manual use of a level to check installation after it is complete for any readjustment. Manual adjustment, tightening and the like indicates a user/installer of the toilet bowl or assembly using only hand operation to carry out a given operation. A "toilet assembly," unless indicated otherwise herein, is intended to mean either a two-piece toilet assembly in which the toilet bowl and a toilet tank are separately made and installed by attaching the tank and bowl together as an assembly or a one-piece unitary toilet wherein the bowl and tank are manufactured as one piece. A "toilet bowl" as used herein can refer to a toilet bowl for use as a stand alone installation without a tank or as the bottom portion of a unitary one-piece toilet assembly.

As used herein, words like "right," "left," "upper," "lower," "interior," "exterior," "outer," and "inner" and words of similar import are intended to be used and interpreted with reference to the drawings hereto and indicate directions in the drawings for the reader's convenience and are not intended to be limiting.

The kits herein can include kits for installing a toilet bowl or a toilet bowl assembly. When installing just a toilet bowl or a one-piece toilet assembly, the kit may include required as well as optional components for installing the toilet bowl on an installation surface. Optionally, following use of a toilet bowl installation kit herein, a tank may be optionally installed in any manner known in the art if needed. In addition, such a toilet bowl installation kit can be used to secure a toilet assembly wherein the assembly is a one-piece assembly so that only the bowl portion need be installed on the installation surface in a given installation. Kits are also included herein for preferred installation of two-piece assemblies wherein the tank and bowl require separate installation steps according to a preferred embodiment herein. The method herein includes steps for installing a toilet bowl on an installation surface that can be used for just installing a bowl portion or for installing assemblies that are one-piece unitary assemblies. The method may include preferred optional steps for also installing a tank over a toilet bowl in a two-piece assembly. The invention further includes an installed toilet assembly that has been installed using a kit and/or method herein as described further below.

Figure 1:
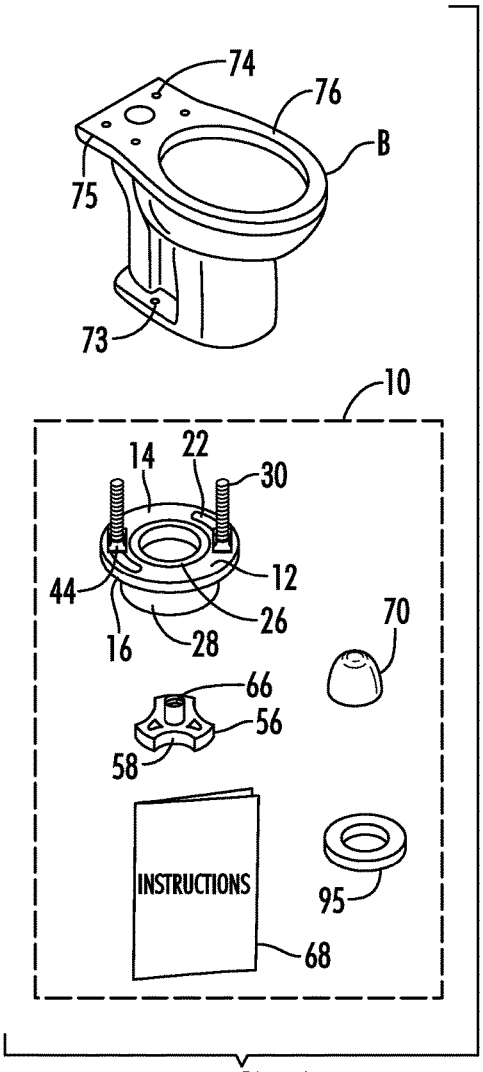
FIG. 1 shows a perspective representation of components of a kit for installing a toilet bowl according to one embodiment of the invention.
Figure 2:
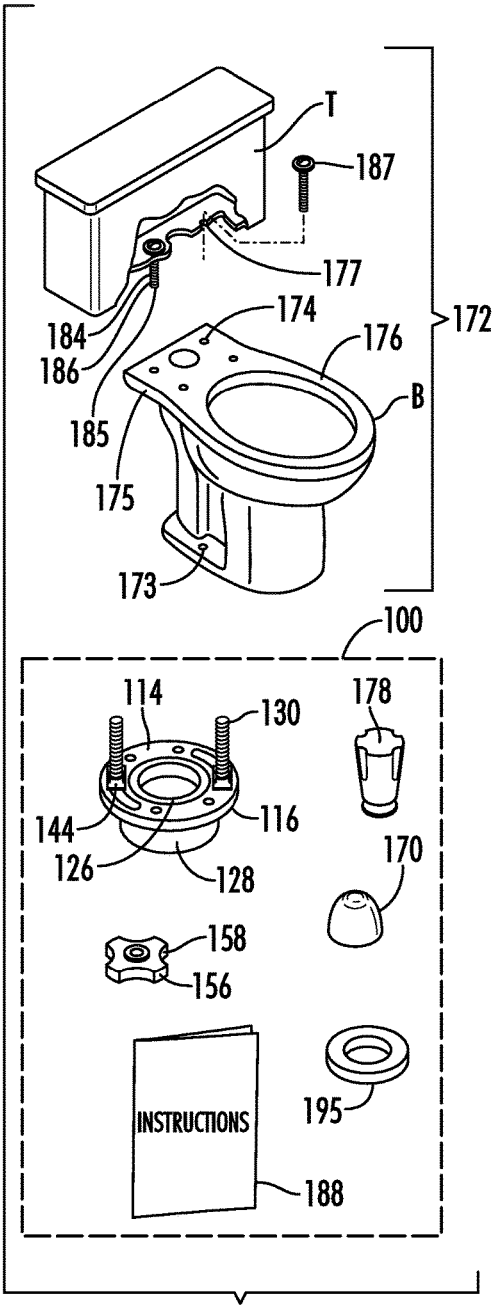
FIG. 2 shows a perspective representation of components of a kit for installing a toilet assembly having a toilet tank and a toilet bowl according to another embodiment of the invention.

With reference to FIG. 1, a first kit, generally referred to herein as kit 10, is shown including a flange bolt 30 and a bolt locking knob 56 and instructions for installation 68. Optionally, the kit includes a flange 12, a flange nut 44, a cover 70 for placing over the locking knob 56 after installation, and/or a wax seal 95 as is ordinarily used in toilet bowl installation and a bowl B for installation. A second kit, generally referred to herein as kit 100 is shown generally in FIG. 2, wherein all elements are the same as those of kit 10. In kit 100 use of analogous reference numbers indicates those elements are the same (e.g., bolts 30 and 130 are the same). Preferably, kit 100 includes a flange bolt 130, a bolt locking knob 156, a handle fastener 178 and instructions for installation 188. Optionally, the kit 100 may include a flange 112, a flange nut 144, a cover 170 and/or a wax seal 195. Kit 100 may include all of kit 10 with additional elements as described further herein.

In kit 100, a toilet assembly 172 is shown having a bowl B and a tank T which can be installed with kit 100. The kit may include a flange 112 (which is the same as flange 12). Such flanges may be any standard closet flange, which flanges come in many varieties, and can be optionally included in the kit for installation of a toilet bowl, for circumstances where the pre-installed already existing closet flange from the last toilet bowl is no longer useful, or it is a first installation, and no flange is pre-installed on the floor. A tank locking bolt(s) 184 may also be provided to the kit 100 for connecting the tank T to the bowl B. The tank locking bolt 184 may be positioned within the tank, and a standard tank spud 194 and tank seal 193 may also be used. Each one of the above items for use in one or both of the kits is described in further detail herein below.

Figure 6:
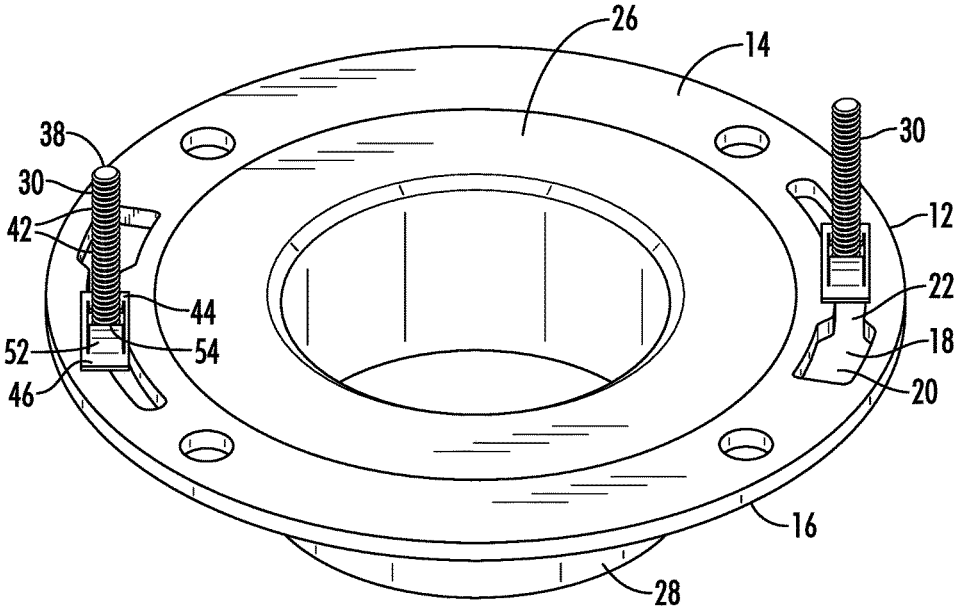
FIG. 6 is a perspective view of the flange and bolt combined with a flange nut for use in the invention.

Flange 12 is preferably generally round or generally circular in outer peripheral configuration and is sized as are general prior art toilet closet flanges. A wide variety of such flanges exists, and may be used with the kits and assemblies herein. The outer peripheral shape may be varied depending on the design of the toilet or for manufacturing convenience without departing from the spirit of the invention. Preferably a circular shape is preferred in view of the most common design of the underside of most toilets having a drain opening and configuration that best accommodates a circular flange. It will be understood that flange 112 is the same as flange 12 herein in all respects and may also be varied in the same manner as flange 12. With reference to FIGS. 1, 4 and 6, the flange 12 has an upper surface 14 which is intended to lie below and face the bottom surface of a toilet bowl and a lower surface 16 which is intended to contact an installation surface S (see FIGS. 3 and 10). In some embodiments as in known in the art, a wax seal 95, 195 may be placed between the flange and the lower surface of the toilet bowl to seal an opening around the toilet bowl as it meets a drain opening (see, e.g., FIGS. 11 and 12). The flange 12 used further has a hole 24 which extends through the central area of the flange 12 from the upper surface 14 to the lower surface 16 of the flange 12 so that for generally circular flanges, the hole creates an annular flange configuration. At least one opening 18, and preferably at least two openings 18, and most preferably two such openings 18, are further made through the flange along its upper surface 14 extending from the upper surface 14 to the lower surface 16 configured for accepting a flange bolt. Optional floor mounting holes (two to four or more of such holes) as are known in the art, such as holes H may also be provided.

The opening 18 may have varied configurations, but in the preferred embodiment described and shown herein, it has an elongated shape which is curved in the manner of the annular upper surface 14 of the flange when the flange is generally circular as shown. A first portion 20 of the opening 18 in the flange 12 is shaped so as to easily accept therethrough a bolt head and preferably matches the shape and is slightly larger than a flange bolt head such as the head of bolt 30. A second, slot-shaped portion 22 of the opening 18 is the portion that extends more narrowly than a bolt head in a curved manner along the flange. It preferably has a width that is wide enough to snugly accommodate a bolt stem, but not a bolt head. It has a length which may vary, but which is long enough for slide positioning a flange bolt, but not so long as to have a significant negative impact on structural integrity of the flange.

The flange 12 may be one of a variety of flanges. As shown herein, the flange is a flange having a downwardly extending insert. The insert 26 sits within hole 24 and is made so that it sits snugly within the rim of flange 12 defining the hole 24. A portion 28 of the insert 26 extends downwardly below the flange. Insert 26 is optional, and represents just one of several known flange designs in the art. The insert can fit within the interior of the end of a drain conduit D for facilitating elimination of waste flow from the toilet bowl B when installed. A flange is typically already in place upon installation of a replacement bowl and so the nature of the existing flange, which has bolt-receiving holes is not always something the installer has to change. In some instances, however, the installer may wish to change the flange, the flange may be damaged or the installation in a new location which did not have a pre-installed flange, in which case a preferred design to accommodate the flange bolts 30, 130 herein can be obtained as an optional feature in a kit or assembly herein.

The flange 12 is preferably made of metals, such as steel, aluminum, and the like, but may also be formed of a polymer, composite material, or reinforced polymer so long as it is sufficiently structurally strong to support the toilet and function as an adequate toilet bowl closet flange in a manner at least as adequate as is known in the art.

The flange bolt(s) 30 as noted above of the invention is/are best shown in FIGS. 1, 2, 5 and 6 (or flange bolt 130 in kit 100). At least one such bolt is provided, preferably at least two such bolts 30 are provided, and more preferably two bolts 30. Each such bolt 30 has a bolt head 32 and a bolt stem 36. The bolt stem 36 extends from the bolt head 32 to an end portion 38 opposite the bolt head 32. The bolt stem 36 has an outer surface 40 along its length l. The bolt head 32 is preferably configured so as to fit through the first portion 20 of the opening 18 in the flange 12. Once within opening 18, the bolt head is slid along the opening 18 into the slot-like portion 22 of the opening 18 to adjust its position. When properly positioned, the bolt head 32 at least partially contacts the lower surface 16 of the flange 12. The end portion 38 of the stem 36 will then extend upwardly from the upper surface 14 of the flange. The bolt head 32 is preferably generally planar on the top and bottom surfaces of the bolt head 32 go give a generally flat appearance for lying beneath the flange in a flat configuration for stability. The outer periphery P of the bolt head 32 has a shape which may be varied, but as shown in the preferred embodiment described herein, it has a generally rectangular shape. It may also be circular, square, triangular and the like. However, the peripheral shape of the bolt head 32 should be such that it is able to fit within the first portion 20 of the flange opening 18.

The bolt stem outer surface 40 is preferably configured in the manner of a standard bolt and has threads 42 on the outer surface thereof. Unlike prior art flange bolts, the flange bolt 30 herein, is preferably pre-sized for use in the kits 10, 100 for fitting easily within the toilet bowl B for which the kit 10, 100 is to be used for installation and accommodating knob 56 described here. The length l of the bolt stem 36 is preferably pre-sized before assembling the kit to extend through the base of the toilet bowl B a distance such that the bolt is sufficiently received within the interior of bolt locking knob such as knob 56 described further herein below. Thus by pre-sizing the bolt stem length l and coordinating it so that its end portion 38 is substantially located within the bolt locking knob 56, use of bolt cutters and saws may be eliminated.

Figure 4:
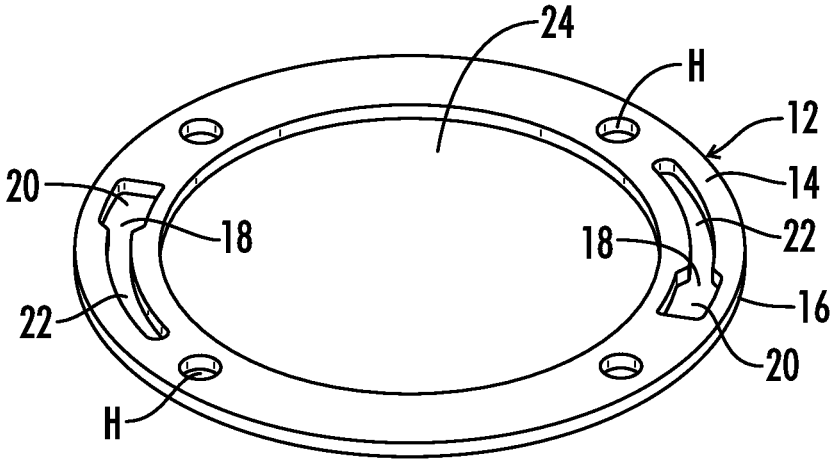
FIG. 4 is a perspective view of a flange for use in the invention.
Figure 4A:
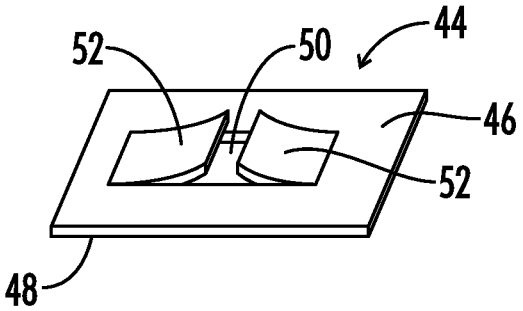
FIG. 4A is a perspective view of a flange nut for use in the invention.
Figure 5:
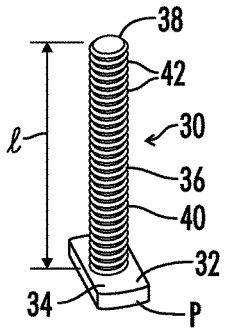
FIG. 5 is a perspective view of a flange bolt for use in the invention.

Once the flange bolt(s) 30 is/are positioned within the flange opening(s) 18 as described above and as shown in FIG. 6, so that the bolt head(s) 32 is/are at least partially contacting the bottom surface 16 of the flange and the end portion(s) 38 of the bolt stem(s) 36 is/are extending upwardly, at least one optional flange nut 44 (flange nut 144 in kit 100), preferably at least two flange nuts 44, and most preferably two flange nuts 44 can be provided for stabilizing the bolt(s) 30. The flange nuts 44 are preferred in that they can stabilize the bolts during installation. The flange nuts 44 are preferably configured to fit over the end 38 portion of the bolt stem 36 and pass over the stem 36 so that at least a portion of the flange nut 44 contacts the upper surface 14 of the flange 12 and is stably locked against the bolt stem 36. As shown in a preferred embodiment herein, as best seen in FIGS. 4A and 6, the flange nut 44 has a generally planar upper surface 46 and a generally planar lower surface 48. An opening 50 is positioned near or in the center of the flange nut extending from the upper surface 46 to the lower surface 48 of the flange nut. Surrounding the opening 50, at least two bent portions 52 are formed to extend upwardly and outwardly from the upper surface 46 of the flange nut 44. In use, the flange nut is fit either laterally and/or through rotation over the end portion 38 of the stem 36 and then passed in reasonably tight fit along the length of the stem 36 until the lower surface 48 of the flange nut 44 comes close to and preferably at least partially touches the upper surface 14 of the flange. In doing so, the tensioned and bent portions 52 of the flange nut press against the stem for stability helping to lock the flange in place at a point of contact 54 as shown in FIG. 6. Preferably, if the outer surface of the stem is threaded as shown in FIG. 6, the point of contact 54 can lock between threads on the surface of the stem.

Other embodiments and configurations of a flange nut that are capable of doing the same function are also envisioned herein which can be generally circular in configuration with one or more upwardly and/or inwardly extending locking portions, which may include fingers for engaging or locking against the outer surface of the stem 36 or which screw onto the bolt 30 may be substituted for preferred flange nuts 44. Similarly, a spring-tensioned flange nut having, instead of a generally planar upper and lower surface, a curved cross-sectional configuration is also suitable. One alternative flange nut may have a flat lower flange portion and an upwardly extending circular bolt portion that fits over the bolt and can be screwed on threads 42 on the outer surface 40 of the bolt 30 until the lower flange portion of the flange nut contacts the upper surface of the flange. It is preferred however that regardless of the flange nut configuration used, the flange nut fit as close to the flange and as snugly as possible for stabilizing the bolt during bowl installation.

Figure 7:
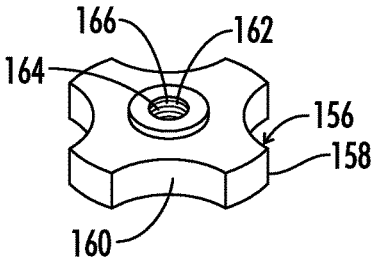
FIG. 7 is a perspective view of the bolt locking knob for use in the invention.
Figure 7A:
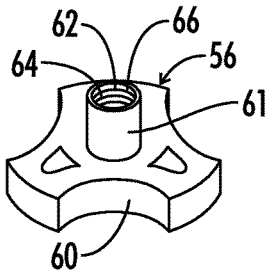
FIG. 7A is a bottom elevational view of the bolt locking knob of FIG. 7.

The kits 10, 100 further include a bolt locking knob 56 (or 156 for kit 100). The bolt locking knob 56 preferably has an outer peripheral configuration which is shaped for manual tightening, and thus may be varied from a smooth surface having knurling for gripping to a surface having surface features that facilitate manual operation of the knob. The surface thus may be shaped for easy grabbing. In preferred embodiments as shown herein (see FIGS. 1, 2, 7, 7A and 13), the outer peripheral surface 58 may have a shape having curved depressions 60 therein that allow easy gripping and turning for manual tightening of the knob. As shown in FIGS. 7 and 7A, the shape can include three or four or more such depressions and various configurations for gripping.

Tightening may occur by a press down, force-fit or other lock-down feature, by inner snap-fit to the outer surface of the bolt stem or a variety of interlocking features that can be used. As shown herein, and for simplicity, a preferably pre-sized flange bolt extends through the base of a toilet bowl with which the kit is to be used, and the bolt locking knob 56 is configured with an interior surface 62 that defines an opening 66 extending therethrough. The interior surface 62 is preferably configured so that when the end 38 of the bolt stem 36 is placed within the opening 66, the interior surface 62 of the knob 56 contacts the outer surface 40 of the bolt stem 36 in locking engagement and the knob 56 is able to be hand tightened on the bolt stem 36 when a toilet bowl base is positioned in place over the flange with the bolt extending through the mounting holes. In the preferred embodiment shown herein, the interior surface 62 of the knob 56 has mating threads 64 that lockingly engage the threads 42 on the outer surface 40 of the stem 36 of the flange bolt 30. One or more such knobs 56 may be provided to the kits depending on the number of flange bolts 30 to be used in the flange 12.

In one preferred embodiment shown in FIGS. 1 and 7A, for use with a kit 10 for installing a toilet bowl, the locking knob 56 has a downwardly extending portion 61. FIGS. 1 and 7A show a bottom perspective view of the knob so that the downwardly extending portion 61 appears to be extending upward. In use, however, the portion 61 would extend downwardly. By using a knob 56 with a downwardly extending portion, upon tightening of the knob 56, the downwardly extending portion would extend downwardly into a mounting hole 173 in the base of a toilet bowl B. It is preferred that the interior surface 62 defining opening 66 extends through the knob 56 and the downwardly extending portion so as to fit around and accommodate the end portion 38 of the bolt 30. Threads 64 may further extend within the downwardly extending portion. When the end portion of the bolt 30 is within the interior surface 62 of the knob, the downwardly extending portion 61 is in the mounting hole 173 in the base of the toilet bowl, the end portion is substantially within the knob 56. Preferably the entire end portion 38 of the bolt is within the knob 56, but it is within the scope of the invention that a small portion may in some cases extend above the knob, provided that it is such that it would not interfere with smooth no-tools installation, require cutting of the bolt and/or interfere with the installation of an optional decorative cap such as cap 70 of FIG. 9B.

By using the size of the interior surface 62 and the opening 66 in a coordinated manner with the size of the bolt 30, bolt cutting and adjustment can be eliminated. Further, when a preferred downwardly extending portion 61 is provided to the knob, this coordination can be made even easier and the installation more stable by providing more contact between the exterior surface of the bolt 30 and the interior surface 62 of the knob 56 and by including the downwardly extending portion 61 within the mounting hole. Engaging threads on both surfaces can provide a tight and stable connection between the bolt and the knob without bolt cutting to fit the bolt to the knob, as the bolt is pre-sized to fit within the knob. Further, by using the downwardly extending portion 61, the bolts can be pre-sized to work with the knob, but still have a standard flange bolt size if so desired.

Instructions 68 for installing the toilet bowl are also provided. Such instructions 68 should be written so as to provide user instructions for insertion of the flange bolt(s) 30 in a flange such as flange 12, adjustment of the bolt(s) and securement thereof if desired by optional flange nut(s) 44, placement of the flange on the installation surface over the drain D, if not already pre-installed, and optional securement of the flange to the installation surface in a manner known in the art, optional placement of the wax seal in a manner known in the art, and lowering of the toilet bowl over the secure flange bolts, followed by locking engagement by the user of the bolt locking knob(s) 56 on the end portion(s) 38 of the stem(s) 36 of the flange bolt(s) 30. Such instructions can further include other standard information known in the art for toilet bowl installation, such as connection of a water or liquid supply line, sealing of the lines and drain outlet, adjustment or leveling if needed, and if connected to a flush valve without a tank or if the toilet bowl is part of a unitary toilet assembly, installation and initiation of operation of a flush valve in a manner known in the art may also be provided. Optional installation of a tank in any manner known in the art (including the preferred method noted herein) may also be optionally provided.

For kits 100, which include a toilet assembly 172 having a tank T and a bowl B, instructions 188 may be provided, which further include instructions for mounting the tank T using a tank locking bolt(s) to a rear portion 175 of an upper surface 176 of a bowl B. After installation of the bowl B according to instructions, such as instructions 68 noted above, instructions 188 further explain that a tank is provided which has a bolt hole 177, preferably at least two or more such bolt holes 177 and most preferably two or three such holes 177, in the bottom of the tank through which a tank locking bolt(s) 184, preferably at least two or three tank locking bolts 184, would be placed so as to downwardly extend from the tank. The tank T typically further has a downwardly extending spud 194 over which a seal such as a tank seal 193 is placed (see FIGS. 2 and 14).

The instructions 188 preferably explain that the tank T is lowered over mating tank mounting hole(s) 174 in the rear portion 175 of the upper surface 176 of the bowl B so that the tank locking bolt(s) 184 extend through tank mounting hole(s) 174 and end(s) of the bolt(s) extend downwardly through the bottom of mounting holes at the rear portion of the bowl in a manner known in the art. Once in place, a handle fastener(s) 178 as described herein are provided and are manually tightened on the protruding downwardly extending end(s) of the bolt(s) 184.

Figure 8:
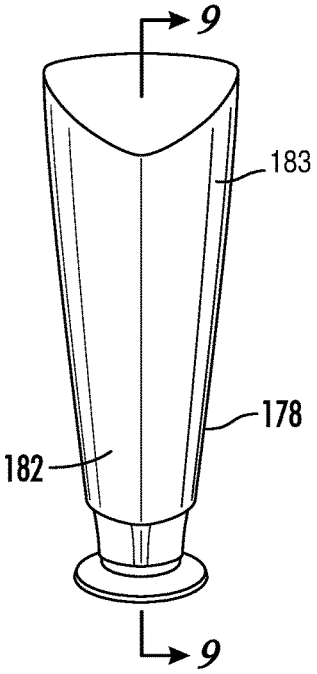
FIG. 8 is a perspective view of a handle fastener for use in the invention.
Figure 9:
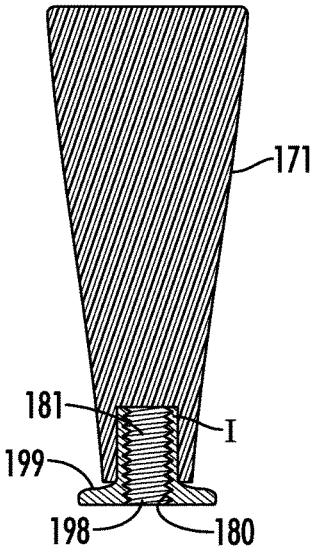
FIG. 9 is a cross-sectional view of the handle fastener of FIG. 8.
Figure 14:
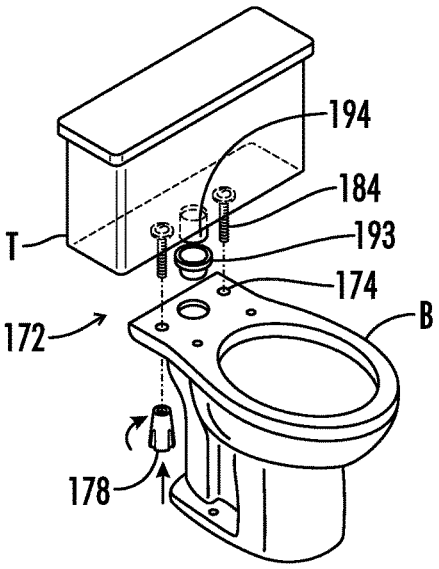
FIG. 14 is a perspective view of a toilet tank being placed over a toilet bowl and placement of a handle fastener according to one embodiment of the method herein.

In use in kit 100, a handle fastener 178, as shown in FIGS. 8, 9 and 14 has an interior surface 180 defining an opening 198 therein. The opening 198 is configured to receive an end of a tank locking bolt such as bolt 184. The bolt may be received by snap-fit, locking fit, roughened or knurled surfaces and the like, but is preferably received by providing outer threads 186 on the tank bolt(s) and mating threads 181 on the interior surface 180 of the handle fastener. The outer surface 182 of the handle fastener is configured so as to be long enough and to be shaped to facilitate manual gripping and turning of the handle to tighten the tank T to the bowl B to create a toilet assembly 172. Since such areas where tank bolts are normally attached occur at the rear of the bowl which can be difficult to reach, especially in smaller installation areas, the handle fastener 178 preferably extends downward for easy gripping. It may also have an outer surface 182 for easy gripping, such as by providing groove features 183 to the outer surface. The handle fastener(s) are configured so as to enable and facilitate easy manual tightening on a tank locking bolt. As shown in FIG. 9, the opening 198 defined by the interior surface 180 need not fill the entire length of the handle fastener. The interior of the fastener other than the opening may be a solid piece as shown in FIG. 9 or partially hollow as shown in an alternative design 178' in FIG. 9A. The fastener may be formed to include a polymer material, a reinforced polymer, a composite a metal material or combinations thereof. Particularly if formed of metal, it is preferred that the outer surface of the fastener where gripping occurs be coated with a polymer-type material or other coating for ease in gripping and for design purposes so as to color the handle fastener to match the bowl B if possible.

Regardless of the handle fastener body material, it is preferred that the interior surface 180 that defines the receiving portion for bolts 184 be formed of metal so as to provide metal threads for mating with tank locking bolt threads 186. However, a polymeric material, reinforced polymer or composite surface is also acceptable.

Figure 9A:
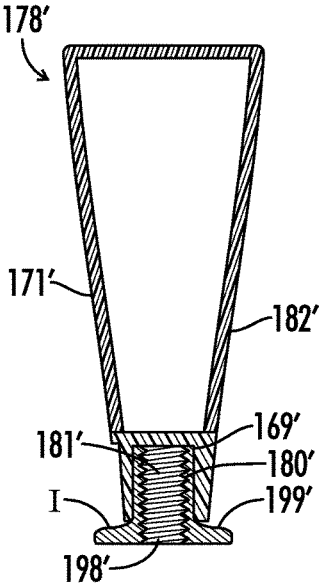
FIG. 9A is a cross-sectional view of a handle fastener having a hollow interior.
Figure 9B:
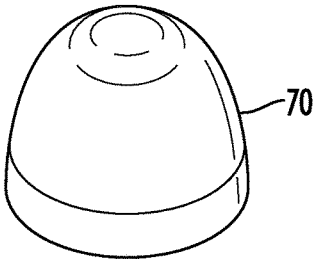
FIG. 9B is a perspective view of a cover for a flange bolt for use in the invention.

The handle fastener 178 may be a one-piece or two-piece releasably detachable fastener. As shown in FIG. 9, the handle fastener has a handle portion 171 and an attachment portion 199. These portions may be joined, affixed, molded or otherwise formed as a unitary piece. Alternatively, as shown, the attachment portion 199 can be made to be a detachable piece, in which case the interior surface 180 defining opening 198 is within a detachable insert portion I fit within handle portion 171. The insert portion is snugly fit into the handle portion 171 (or otherwise, for a hollow handle portion, can be fit in a mating receiving recess 169' or other feature as shown in FIG. 9A) and after turning and tightening the fastener handle 178 to the satisfaction of the installer, the longer handle portion 171 may be longitudinally pulled downwardly and/or otherwise detached from the attachment portion 199. This will leave the portion 199 as a tightened cap on the tank mounting bolt ends. The handle portion can be reattached or simply left on the portion 199 after this is done. The installer may want to leave the handle portion, particularly if the same color as the toilet, so that it is easy to find for any future adjustments or for removal, replacement or repair of the tank.

In addition, all bolts used herein whether flange bolts, tank locking bolts and the like, while preferably metallic (e.g., bronze or steel) for strength and stability, may also be formed of composite materials, polymers, reinforced polymers capable of being machined, roughened or molded for locking, and which have sufficient structural integrity to withstand the forces and weights involved with installation of the toilet bowl. Instructions 188 may further provide additional instructions for installation of various types of flush valves in tank T, attachment thereof and of the tank generally to water lines and drain lines, and the like. Instructions 188 may further include optional information on installation of a flush handle or other flush actuator and tank lid installation information.

Each of the kit instructions 68, 188 may also include optional information on maintenance, cleaning and replacement of parts used for installation herein, ordering information and the like normally found in instructions for installation of toilet bowls and toilet assemblies.

In each of the kits 10, 100, an optional cover 70, 170 may be provided which is configured to be placed in a preferably snug manner over a bolt locking knob 56, 156. If more than one knob is used, multiple covers 70 may be provided. The cover 70 as shown in FIGS. 1-3, 9B and 13 is preferably molded of a plastic or reinforced plastic or composite so as to be colored to match the base of the bowl for design purposes and for easy cleaning, although a coated metal cap or decorative metal cap that preferably resists corrosion may also be used.

In either of the kits 10, 100 and assemblies described herein, at least one mounting block 200 may be provided. With reference to FIG. 16, such mounting block(s) are of a length $l_1$ measured longitudinally along the mounting block 200 that is about the same as or larger than a width measured transversely across a toilet bowl along its lower surface 196 (see FIG. 11). The block(s) 200 are preferably configured so as to suspend a portion of the toilet bowl B above a mounting surface S during installation. By doing so, the installer will be able to more easily ensure placement of a flange bolt through a mounting hole in the base of the toilet bowl to be installed. If only one such block is used, then either a front, back or side of the bowl is suspended. This will allow for at least one flange bolt to be maneuvered into the mounting hole through slight movements of the suspended bowl while on the mounting block without having to hold the bowl in the air over the flange for longer periods of time while trying to position the mounting holes over the flange bolts. While this is far easier with kits according to the invention which support and create more stable mounting bolts, the process is even further enhanced by use of mounting blocks in that the installer need spend even less time holding the bowl suspended over the bolts (even when properly aligned).

In practice, as shown in FIG. 16, two such mounting blocks are preferred, although one or more than two may be used. In using two such blocks, they are preferably of about the same size, although this need not be the case. Preferred sizes for standard toilet bowls are mounting blocks of about twelve inches long by about 2 inches wide and 2 inches high (although variation in such measurements is clearly contemplated depending on the toilet to be installed as well as the size of the flange, height from the floor, etc.). The blocks 200 may be positioned so as to align generally with the front and rear portions of the lower surface 196 of the toilet bowl B such that when the bowl B is lowered upon the blocks, the base of the bowl rests comfortably and stably on the blocks upon an upper surface 202 thereof. When the bowl is resting on the mounting blocks, if such blocks are included, it is easier for the installer to take the time to view the mounting holes in the base of the bowl and make slight movements and maneuvering of the toilet bowl position to better align the holes with the ends of the mounting bolts. Then when the bolts are so aligned, the blocks can be removed leaving the bowl properly positioned with the bolts in place. At least two blocks (or an event number) are preferably provided for stability.

The blocks 200 can optionally be manufactured so as to have some sort of pull tab 204. As shown the pull tab is an extending strap 204 from the side of each block 200, which enables a user when pushing up, slightly lifting or suspending the toilet a little above the block (now that the bolts are aligned), to easily pull on the tab to assist in removing the blocks without place hands and fingers in the area where the bowl may inadvertently land on the user's hands. Such pull tabs may be rope, cord, leather, polymer, a handle, and the like, so long as they provide a basis for gripping and pulling out the block.

The blocks 200 are preferably formed of a material having sufficient strength to suspend a toilet bowl during installation so as to allow a user to ensure placement of a flange bolt(s) in corresponding mounting hole(s) in a base of the toilet bowl. It is also preferred that the blocks are formed using a material or materials that will not mar the surface on which the toilet or bowl assembly is to be mounted. Preferably, such materials would suspend and hold the weight of the bowl for at least several minutes, preferably several hours, and most preferably for at least a day. Suitable materials may be found for such purpose that include primary base of wood, oriented strand board, medium-density or high-density fiberboard, metal, metal alloys, foam, polymeric materials and composites thereof. Laminated and coated structures are also possible. Color coating or markings may be desirable from an instructional, advertising, aesthetic and/or safety purpose.

The instructions 68, 188 in the kits may further include details and steps associated with a preferred method described herein for installing a toilet bowl without using tools or for installing a toilet bowl and tank in a toilet assembly without using tools. The method as described herein is the preferred method and is not intended to be limiting.

An assembly 11 for installing a toilet bowl and an assembly 111 for installing a two-piece toilet assembly wherein the toilet assembly includes a bowl portion and a separate tank portion are also included herein. With respect thereto, such assemblies 11, 111 include the same components as the kits 10, 100 with the exception that the assemblies include the parts, with instructions for installation being optional and that for the assemblies 11, 111, a flange is required, whether a pre-installed flange or a new and/or replacement flange. Thus, any assembly 11 of the required components as described hereinabove with respect to the kit 10 of the invention, but including a flange 12 as described herein, a flange bolt 30 and a bolt locking knob 56, regardless of whether the flange 12 is pre-installed and/or newly provided as a new part or replacement part is within the scope of the assembly, even aside from inclusion of instructions needed for forming a kit 10. Similarly, with an assembly 111 for installing a two-piece assembly, the components are as described above with respect to kit 100, but instructions are optional, and a flange 112 is required in the assembly, even if provided as a pre-installed flange, instead of as a new or replacement flange 112. Such an assembly 111, in addition to the flange 112, would include a flange bolt 130, a bolt locking knob 156 and a handle fastener 178. Each assembly 11, 111 may include the various other optional features noted hereinabove for kits 10, 100 as well as inclusion of optional mounting blocks 200.

In an embodiment of the method of the invention, a flange bolt, such as one or more flange bolts 30 described herein, is inserted through an opening(s) in the flange. Preferably a flange such as flange 12 as described herein is used or is already in place on the installation surface from a prior toilet installation.

Figure 10:
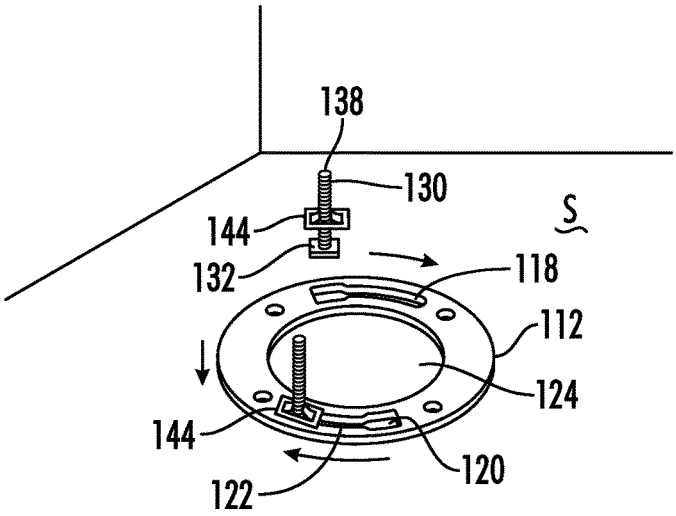
FIG. 10 is a perspective view showing placement of a flange, flange bolts and a flange nut in accordance with an embodiment of the method herein.

The flange having a flange bolt inserted therein is preferably positioned against an installation surface such as surface S (see FIG. 10). If the flange is already in place on the surface, the bolts are simply inserted into the flange bolt openings 18. The end portion(s) 38 of the bolt stem(s) 36 should be extending upwardly from the installation surface through the opening in the flange, and the bolt head should be contacted at least partially with the lower surface of the flange near the opening in the flange.

A flange nut, such as flange nut 44 described herein, may then be optionally placed over the bolt stem 36 and passed over the stem 36 until at least a portion of the flange nut 44 contacts the upper surface 14 of the flange 12, so as to stably lock against the bolt stem, thereby securing the bolt in place on the flange to avoid movement on installing the bowl. As shown in FIG. 10, bolt 130 is inserted in end 120 of opening 118 as shown in the upper portion of the flange. As shown, the flange nut is partially installed on the first upper bolt 130. The bolt(s) are then positionally adjusted by sliding in the direction of the curved arrows in FIG. 10 in openings 118 through portions 122 of the openings 118 until the bolts are positioned as shown by the lower bolt in FIG. 10. The flange nut 144 shown in FIG. 10 is then pushed downward in the direction of the downward arrow in FIG. 10 on the bolts (and may also be rotated thereon) so as to contact at least partially the flange 112.

Figure 11:
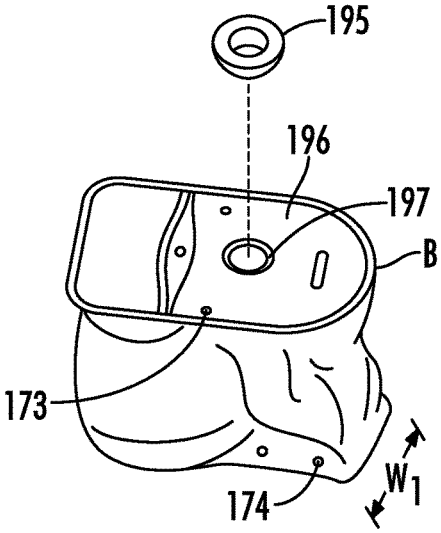
FIG. 11 is a perspective view of a toilet bowl for installation receiving a wax seal thereon.

Referring now to FIG. 11, the toilet bowl B which preferably has a mounting hole 173 (or two such holes as shown) extending through a base of bowl B is provided. It can be prepared before installation by turning over so as to have under surface 196 facing upwards and a wax seal 195 as is known in the art can be placed over drain opening 197 in bowl B. The bowl can then be turned right-side-up for further installation.

Figure 12:
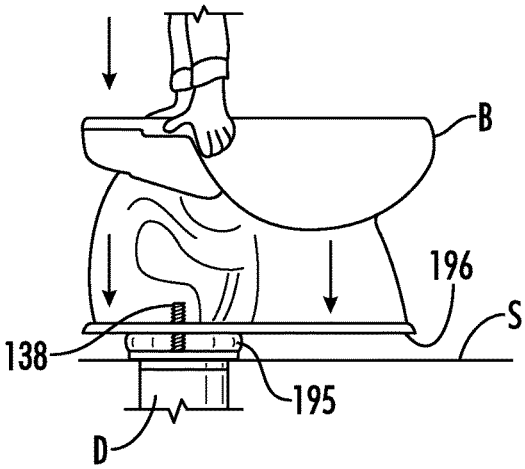
FIG. 12 is a side elevational view of an installer compressing a toilet bowl over a flange herein.
Figure 13:
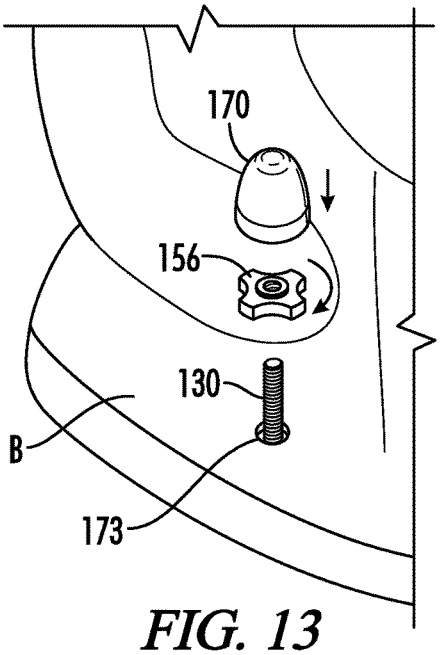
FIG. 13 is a perspective view of placing a bolt locking knob and cover on a flange bolt at a base of a toilet bowl according to an embodiment of the invention.

The toilet bowl B is then lowered so that the mounting hole(s) 173 are passed over the stem(s) 136 of the flange bolt(s) 130 (see FIGS. 10 and 12). In doing so, as is known in the art, the user, presses downwardly in accordance with the arrows shown in FIG. 12 to compress the wax seal 195 and push the lower surface 196 of the bowl to the installation surface S. Once this is done, the end portion(s) 38 of the flange bolt(s) 130 extend upwardly through the mounting hole(s) 173 as shown in FIG. 13.

In one embodiment herein, before positioning the bowl over the flange bolts 30, 130, the method may optionally include positioning one or more mounting block(s) 200 on mounting surface S (see FIG. 16). If positioned so as to align with the front and/or rear portions of the lower surface of the toilet, the block(s) will at least partially suspend the toilet bowl above the surface S, in the case of a single mounting block, or fully suspend the toilet bowl above the mounting surface S in the case of two or more such mounting blocks. The toilet bowl is then lowered over the flange bolts so that the ends of the flange bolts are aligned and extend upwardly through the mounting holes on the bowl base and let down so that the lower surface of the toilet bowl contacts the upper surface 202 of the mounting block(s) and then the bowl is resting on such block(s) (see FIG. 17). Should the hole(s) and bolt(s) not be properly aligned, the installer can maneuver the bowl to better position and align the hole(s) and bolt(s) without having to hold the bowl in total unsupported extension while ensuring alignment. Once the bolts are positioned in place, the bowl can be slightly lifted, tilted or partially suspended above the blocks a distance sufficient to loosen the blocks. If pull tabs 204 are provided, the blocks can be simply pulled out using such tabs while the bowl is slightly lifted, etc. or a user would have to move the blocks manually out from under the toilet bowl.

A bolt locking knob 156 (which may have the design as shown in FIG. 7 or as shown in FIG. 7A with respect to knob 56) is then placed over the end portion 138 of the flange bolt stem 136. The bolt locking knob may be as described above so as to have an interior surface 162 defining an opening 166 extending therethrough. The interior surface 162 is preferably configured so that when the end portion 138 of the bolt stem 136 is placed within the opening of the bolt locking knob, the interior surface 162 of the bolt locking knob contacts the exterior surface of the bolt stem in locking engagement. As preferably shown herein, such surfaces have mating threads (on the outer surface of the bolt and the interior surface of the bolt locking knob) that are engaged by manual rotation of the locking knob 156 according to the direction of the arrow in FIG. 13 until manually tightened by the user. A cover such as cover 170 may be optionally placed over the bolt locking knob as shown. If a downwardly extending portion such as 61 in the design of bolt locking knob shown in FIG. 7A is used in the method, the downwardly extending portion would pass into the mounting holes 173 in the base of the toilet bowl. Substantially all, or all, of the end portion 138 of the bolt 130 is within the interior opening 166 of the bolt locking knob.

To install a two-piece toilet assembly having a tank, the above-noted method would further include the steps of installing a tank over the toilet bowl. A handle fastener would be provided, such as handle fastener 178, 178' as described above herein (see FIGS. 8, 9 and 9A). The fastener preferably has an interior surface 180 defining an opening 198 therein and an outer surface 182 configured for manual tightening of the handle fastener as described above with respect to the fasteners 78, 178, 178' in kits 10, 100. It may be a one-piece or two-piece fastener.

A toilet tank such as tank T in FIG. 14 having a tank bolt(s) 184, each having an end 185 extending downwardly therefrom is placed over the toilet bowl until the tank and bowl contact. The bolts may be placed in the holes in the tank before or after the tank is placed on the bowl. The tank bolt end(s) 185 extend downwardly through tank mounting hole(s) 174 in a rear portion 175 of an upper surface 176 of the toilet bowl B so that the end of the tank bolt(s) extends beyond the tank mounting hole out the bottom of the bowl B.

The end of the tank bolt is then inserted in the opening 198 of the handle fastener 178 and the handle fastener is manually tightened on the tank bolt preferably through use of mating threads on the tank bolts 184 and on the interior surface 180 of the handle fasteners 178. If multiple handle fasteners are used on multiple tank bolts, care should be taken to tighten them evenly so that the tank is level. The tank should be preferably leveled upon installation, and the handle fasteners adjusted to accommodate an unequal plane. If a two-piece fastener 178 is used, the handle portion may then be detached or otherwise removed.

In a preferred embodiment, a tank spud 194 as is known in the art protrudes from the bottom of the tank through a spud hole in the tank, and a seal 193 is provided on the spud so that the seal and spud pass in a mating opening on the rear portion 175 of the bowl B for sealing a water channel between the interior of the tank T and the bowl B.

A toilet seat may further be optionally installed on the toilet bowl in a preferred embodiment herein after the tank is installed on the bowl. If any peripheral installation of tank interior equipment such as flush valves and the like is necessary (of is such flush valves need be installed when installing only a bowl as well), such flush valve connections may be done in accordance with any method known in the art, many of which are well known and available. Similarly standard techniques for connecting a water line to a toilet bowl, toilet tank or assembly and/or for connection of flush actuators or handles may also be carried out in any manner known in the art.

Figure 15:
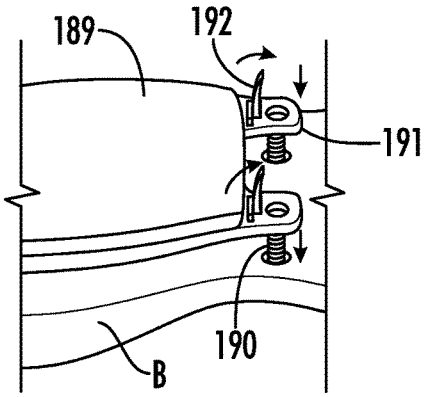
FIG. 15 is a perspective view of installation of a toilet seat on toilet seat mounting bolts on a toilet bowl according to one step of an embodiment of the method herein.

If the toilet bowl is to have a toilet seat assembly such as assembly 189 shown in FIG. 15 mounted thereon, then toilet seat mounting bolts 190 are preferably pre-installed on the bowl B at the manufacturer's location, including standard bolts and washers or other locking mechanisms to hold the bolts in place. However, such bolts 190 can be installed during the method as well. Preferably, the bolts are already installed for the user so as to easily receive the toilet seat assembly 189 and avoid the use of tools. The toilet seat assembly 189 is preferably one which has a hinge connection mounting base capable of easy manual attachment to the toilet seat mounting bolts 190 without the need for the use of tools. Several such designs are known in the art and commercially available, however, standard mounting seat assemblies that require tools may also be used. Preferably the hinge connection mounting base includes a cover that extends over the mounting bolts 190 for a smoother design. Once in place, the cover is snapped over the mounting bolts 190, and is able to snap off again for removal and/or cleaning of the toilet seat assembly and bowl B.

Figure 3:
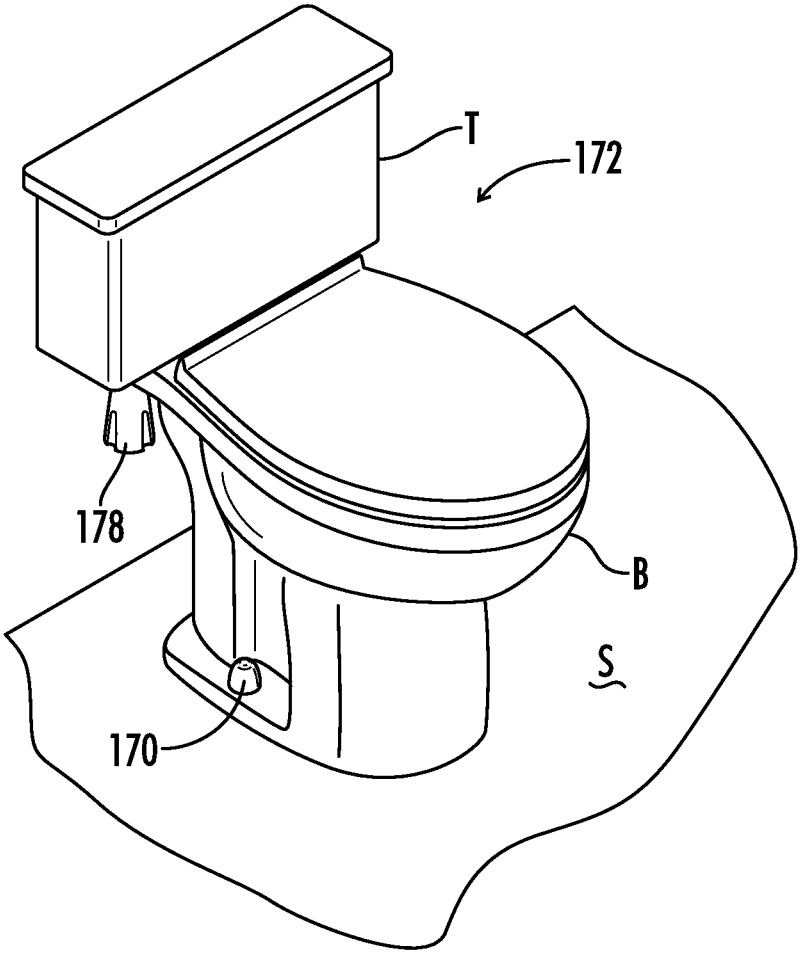
FIG. 3 is a perspective view of an installed toilet assembly according to a further embodiment herein.

Once fully installed, preferably according to the method herein, the installed toilet assembly 172 as shown in FIG. 3, includes toilet assembly 172 having a bowl portion B and a separate tank portion T. The installed assembly preferably includes a flange 112 as described above herein in further detail. The assembly also includes a toilet bowl B having one or more mounting hole(s) such as mounting holes 173 extending through a base thereof. The toilet bowl also has an upper surface 176 having a rear portion 175 thereon that preferably includes one or more tank mounting holes 174 extending therethrough.

The installed assembly has one or more flange bolts such as bolts 130 described herein fit through the flange 112 so that head 132 of the bolt is at least partially contacting the lower surface 116 of the flange 112 and the end portion 138 of the stem 136 is extending upwardly from the upper surface 114 of the flange 112 and through the mounting hole 173 in the base of the toilet bowl.

An optional flange nut(s) such as flange nut 144 described herein is/are fit over the bolt stem so that at least a portion of the flange nut 144 is contacting the upper surface 114 of the flange and is stably locked against the bolt stem.

A bolt locking knob in the assembly, such as locking knob 56, 156 is manually tightened on the bolt stem 136 so that an outer surface 140 of the bolt stem 136 is in locking engagement with the interior surface 162 of the locking knob and they are in locking engagement, preferably threaded locking engagement as described above herein, so as to secure the toilet bowl against the flange and an installation surface such as surface S. Most preferably, the bolt stem is pre-sized to fit within the knob without cutting in a manner as described above which is coordinated with the design of the locking knob used so that substantially all, or all, of the end portion of the bolt(s) is/are within the interior opening in the locking knob.

A toilet tank T in the completed assembly is positioned on the rear portion 175 of the upper surface 176 of the toilet bowl B. The tank preferably has at least one toilet tank locking bolt, such as bolts 184 which are positioned so as to secure the tank and extend downwardly from a bottom surface of the tank T so that the lower end 185 of the tank bolt(s) 184 extends through one or more tank mounting holes 174 on the rear portion 175 of the upper surface 176 of the toilet bowl B. The completed installed assembly also includes at least one handle fastener having an interior surface that defines an opening therein as described above with respect to handle fasteners 178, 178' wherein the opening is configured to receive the end(s) 185 of tank locking bolt(s) 184. The handle fastener(s) are manually fastened on the end(s) of the tank locking bolt(s) in locking engagement, and preferably threaded locking engagement as described above. In the finished assembly, the handle portions 171, 171' may be removed. Preferably the toilet tank is also sealingly installed on the toilet bowl, such as by using a tank seal around a standard tank spud inserted in an opening on the rear portion of the upper surface of the toilet bowl, and the bowl is preferably sealed to the installation surface around a drain outlet using a wax seal as is known in the art.

A wax seal, if used, is preferably positioned on the lower surface 196 of the toilet bowl B and is compressed between the upper surface 116 of the flange 112 and the lower surface 196 of the toilet bowl thereby sealing around the drain conduit D.

Preferably in the installed assembly, a cover such as cover 170 is also placed on the base of the toilet bowl over the bolt locking knob 156. In addition, a toilet seat assembly 189 is preferably also installed in the toilet bowl, using a tool free assembly as noted above and the mounting posts for the toilet seat are preferably covered by a cover extending over the hinge mounting based assembly as shown in FIG. 15.

In one embodiment herein, a method is provided that may be practiced using the kits 10, 100 and assemblies 11, 111 as described herein, or may be adapted for use with existing kits and assemblies known in the art. In this particular embodiment, there is provided a method for installing a toilet bowl on a mounting surface, such as surface S. This method is being described herein with respect to the kits 10, 100 and assemblies 11, 111 of the present invention, but it should be understood that other flanges and kits, assemblies and the like may also be used without departing from the spirit of this embodiment. In this method, after a flange bolt such as, for example, bolt 30 having a bolt head and a bolt stem extending from the bolt head and having an end portion opposite the bolt head, as described herein is positioned through the opening in a flange (whether a prior art flange or one according to the invention herein), and the end portion of the stem extends upwardly from the upper surface of the flange, the flange is positioning on the mounting surface S. The installer then positions a mounting block(s) 200 on the mounting surface S. In doing so, the installer measures the potential locations of the front and rear portions of the bottom surface 196 of the toilet bowl, and places the block or blocks in desired locations so as to contact either or both of these locations.

The toilet bowl having a mounting hole extending through a base thereof is placed so as to be near or over the stem of the flange bolt and the toilet bowl is then lowered until at least a portion of the lower surface of the toilet bowl rests on at least one, and preferably at least two such mounting blocks. The installer then can take his or her time to ensure that the end of the stem of the flange bolt(s) is within the mounting hole and the flange is upright. If not, then the user may move or maneuver the bowl until alignment is achieved. Once this is achieved, the mounting block(s) are removed, preferably, but not necessarily using pull tabs 204.

Unlike the other methods, kits and assemblies hereinabove, this particular mounting block technique may be used with prior art and existing assemblies, kits and methods.

The above kits, methods and finished assembly, through easy no-tools assembly can reduce installation time significantly, preferably to less than 20 minutes and more preferably to less than 15 minutes. In addition, by stabilizing the base and eliminating tools, injuries and installation difficulties, and instances of installation failure are minimized as well.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An assembly for installing a two-piece toilet assembly wherein the toilet assembly includes a bowl portion and a separate tank portion, comprising:

(a) a flange having an upper surface, a lower surface and an opening extending from the upper surface to the lower surface that is configured to receive a flange bolt;

(b) a flange bolt having a bolt head and a bolt stem extending from the bolt head and having an end portion opposite the bolt head, wherein the stem has a length measured longitudinally along the stem and an outer surface and the bolt head is configured so that upon installation of a bowl portion of a two-piece toilet assembly, the bolt head will fit through the opening in the flange so that the bolt head contacts the lower surface of the flange and the end portion of the stem extends upwardly from the upper surface of the flange;

(c) a bolt locking knob having an interior surface defining an opening extending through the knob, wherein the interior surface is configured so that upon installation of a bowl portion of a two-piece toilet assembly, when the end of the bolt stem is placed within the opening of the bolt locking knob, the interior surface of the knob contacts the exterior surface of the bolt stem in locking engagement and the knob is able to be hand tightened on the bolt stem, wherein the length of the bolt stem is pre-sized so that the end portion of the stem of the flange bolt is substantially within the opening in the bolt locking knob; and (d) a handle fastener having a closed end and an interior surface defining an opening therein configured to receive a tank locking bolt for fastening a toilet tank to a toilet bowl in a toilet assembly in locking engagement, the handle fastener having an outer surface configured for manual tightening.

2. The assembly according to claim 1, further comprising a flange nut configured to fit over the end of the bolt stem and over the stem so that at least a portion of the flange nut contacts the upper surface of the flange and is stably locked against the bolt stem.

3. The assembly according to claim 1, further comprising a cover configured to be placed over the bolt locking knob.

4. The assembly according to claim 1, wherein the flange has two openings and the assembly comprises two flange bolts.

5. The assembly according to claim 1, wherein at least a portion of the stem of the flange bolt is threaded and the interior surface of the bolt locking knob is threaded so that the outer surface of the flange bolt is configured for locking engagement with the interior surface of the locking knob through mating threads.

6. The assembly according to claim 1, further comprising at least one mounting block, wherein the mounting block is configured for suspending a portion of a toilet bowl above a mounting surface for ensuring placement of a flange bolt through a mounting hole on a toilet bowl to be installed.

7. The assembly according to claim 6, comprising two mounting blocks, wherein one mounting block is configured for suspending a bottom surface of a toilet bowl in a front portion thereof above a mounting surface and another mounting block is configured for suspending the bottom surface of the toilet bowl in a rear portion thereof above the mounting surface.

8. The assembly of claim 4, wherein the handle fastener is able to be fully tightened by hand, and wherein the assembly allows for complete installation of the toilet tank without requiring use of tools.

9. The assembly of claim 4, wherein the handle fastener is an elongated handle configured to facilitate hand gripping and turning for manually tightening of the handle fastener by hand.

10. The assembly of claim 4, wherein grooves are provided in the outer surface of the handle fastener.

11. A kit for installing a two-piece toilet assembly wherein the toilet assembly includes a bowl portion and a separate tank portion, comprising:

(a) a flange bolt having a bolt head and a bolt stem extending from the bolt head and having an end portion opposite the bolt head, wherein the stem has a length measured longitudinally along the stem and an outer surface and the bolt head is configured so that upon installation of a bowl portion of a two-piece toilet assembly, the bolt head will fit through an opening in a closet flange so that the bolt head contacts a lower surface of a closet flange and the end portion of the stem extends upwardly from an upper surface of a closet flange;

(b) a bolt locking knob having an interior surface defining an opening extending through the knob, wherein the interior surface is configured so that upon installation of a bowl portion of a two-piece toilet assembly, when the end of the bolt stem is placed within the opening of the bolt locking knob, the interior surface of the knob contacts the exterior surface of the bolt stem in locking engagement and the knob is able to be hand tightened on the bolt stem, wherein the length of the bolt stem is pre-sized so that the end portion of the stem of the flange bolt is substantially within the opening in the bolt locking knob;

(c) a handle fastener having a closed end and an interior surface defining an opening therein configured to receive a tank locking bolt for fastening a toilet tank to a toilet bowl in a toilet assembly in locking engagement, the handle fastener having an outer surface configured for manual tightening; and (d) instructions for installing a two-piece toilet assembly having a toilet bowl and a toilet tank.

12. The kit according to claim 11, wherein the bolt locking knob further comprises a downwardly extending portion and the opening in the bolt locking knob extends through the knob and the downwardly extending portion thereof.

13. The kit according to claim 11, wherein the instructions describe a tool-free installation of the toilet assembly.

14. The kit according to claim 11, further comprising a flange having an upper surface, a lower surface and an opening extending from the upper surface to the lower surface that is configured to receive a flange bolt.

15. The kit according to claim 14, wherein the flange has two openings and the kit comprises two flange bolts.

16. The kit according to claim 11, wherein the interior surface of the handle fastener is threaded for mating threaded engagement with threads on an exterior surface of a tank locking bolt.

17. The kit according to claim 11, wherein there are two handle fasteners for receiving two tank locking bolts.

18. The kit according to claim 11, wherein the outer surface of the handle fastener has a surface to facilitate gripping for manual tightening.

19. The kit according to claim 11, wherein the handle fastener is a two-piece fastener having a detachable handle portion.

20. The kit according to claim 11, further comprising at least one mounting block, wherein the mounting block is configured so as to suspend a portion of a toilet bowl above a mounting surface for ensuring placement of a flange bolt through a mounting hole on a toilet bowl to be installed.

21. A method for installing a toilet bowl on a mounting surface without using tools, comprising:

(a) providing a flange bolt comprising a bolt head and a bolt stem extending from the bolt head and having an end portion opposite the bolt head, wherein the stem has a length measured longitudinally along the stem and an outer surface;

(b) inserting the flange bolt through an opening in a flange, wherein the flange comprises an upper surface, a lower surface and the opening, wherein the opening extends from the upper surface to the lower surface and is configured to receive a flange bolt, so that the bolt head fits through the opening in the flange, the bolt head contacts the lower surface of the flange and the end portion of the stem extends upwardly from the upper surface of the flange and positioning the flange on a mounting surface;

(c) placing a toilet bowl having a mounting hole extending through a base thereof over the stem of the flange bolt so that the end portion of the stem extends upwardly through the mounting hole;

(d) placing a bolt locking knob over the end portion of the flange bolt stem, wherein the bolt locking knob has an interior surface defining an opening extending through the locking knob and an interior portion thereof and an outer peripheral surface having a shape having curved depressions for manual tightening of the knob, wherein the bolt locking knob is placed so that when the end portion of the bolt stem is within the opening of the bolt locking knob, the interior surface of the bolt locking knob contacts the exterior surface of the bolt stem in locking engagement and wherein the length of the bolt stem is pre-sized so that upon placement of a toilet bowl over the flange bolt and placement of the bolt locking knob over the end portion of the flange bolt stem, the end portion of the flange bolt stem is substantially within the opening of the bolt locking knob; and (e) fully tightening the knob manually on the bolt stem, wherein installation of the toilet bowl is completed using the method without requiring use of tools, and wherein the bolt locking knob has a downwardly extending portion and the opening in the bolt locking knob also extends through the downwardly extending portion and the method further comprises placing the bolt locking knob such that the downwardly extending portion of the bolt locking knob also extends into the mounting hole in the base of the toilet bowl.

22. The method according to claim 21, further comprising positioning a flange nut over the bolt stem and over the stem so that at least a portion of the flange nut contacts the upper surface of the flange and is stably locked against the bolt stem prior to placing the toilet bowl.

23. The method according to claim 21, further comprising placing a cover over the bolt locking knob.

24. The method according to claim 21, further comprising inserting two flange bolts through two openings in the flange, and placing a toilet bowl having two mounting holes extending through a base thereof over the stems of the two flange bolts so that the end portions of the flange bolt stems extend upwardly through the mounting holes.

25. A method for installing a toilet bowl on a mounting surface without using tools, comprising:

(a) providing a flange bolt comprising a bolt head and a bolt stem extending from the bolt head and having an end portion opposite the bolt head, wherein the stem has a length measured longitudinally along the stem and an outer surface;

(b) inserting the flange bolt through an opening in a flange, wherein the flange comprises an upper surface, a lower surface and the opening, wherein the opening extends from the upper surface to the lower surface and is configured to receive a flange bolt, so that the bolt head fits through the opening in the flange, the bolt head contacts the lower surface of the flange and the end portion of the stem extends upwardly from the upper surface of the flange and positioning the flange on a mounting surface;

(c) positioning at least one mounting block on the mounting surface so that when the toilet bowl is placed over the end of the flange bolt, the toilet bowl is at least partially suspended over the mounting surface for better placement of the bolt in a mounting hole of the toilet bowl;

(d) placing a toilet bowl having a mounting hole extending through a base thereof over the stem of the flange bolt so that the end portion of the stem extends upwardly through the mounting hole;

(e) removing the at least one mounting block;

(f) placing a bolt locking knob over the end portion of the flange bolt stem, wherein the bolt locking knob has an interior surface defining an opening extending through the locking knob and an interior portion thereof, wherein the bolt locking knob is placed so that when the end portion of the bolt stem is within the opening of the bolt locking knob, the interior surface of the bolt locking knob contacts the exterior surface of the bolt stem in locking engagement and wherein the length of the bolt stem is pre-sized so that upon placement of a toilet bowl over the flange bolt and placement of the bolt locking knob over the end portion of the flange bolt stem, the end portion of the flange bolt stem is substantially within the opening of the bolt locking knob; and (g) fully tightening the knob manually on the bolt stem, wherein installation of the toilet bowl is completed using the method without requiring use of tools.

26. The method according to claim 25, further comprising positioning two mounting blocks on the mounting surface, wherein one mounting block is positioned so as to be under a rear portion of a lower surface of the toilet bowl and another mounting block is positioned so as to be under a front portion of the lower surface of the toilet bowl, so that when the toilet bowl is placed over the end of the flange bolt, the toilet bowl is suspended over the mounting surface for better placement of the bolt in the mounting hole of the toilet bowl.

27. An installed toilet assembly having a bowl portion and a separate tank portion and installed according to the method of claim 21.

28. The installed toilet assembly according to claim 27, further comprising a flange nut configured to fit over the end of the bolt stem and over the stem, wherein at least a portion of the flange nut contacts the upper surface of the flange and is stably locked against the bolt stem.

29. The installed toilet assembly according to claim 27, wherein the toilet tank portion is positioned on a rear of the upper surface of the toilet bowl and having a toilet tank locking bolt having a lower end, the toilet tank locking bolt extending downwardly from a bottom surface of the toilet tank portion so that the lower end thereof extends through a tank mounting hole in the toilet bowl; and further comprises a handle fastener having an interior surface defining an opening therein configured to receive the end of the tank locking bolt, wherein the handle fastener is manually fastened on the end of the tank locking bolt in locking engagement, and the handle fastener has an outer surface configured for manual tightening.

30. The installed toilet assembly of claim 29, having two flange openings, two flange bolts, two mounting holes in the base of the toilet bowl and two tank mounting holes in the rear of the upper surface of the toilet bowl, two tank locking bolts in the toilet tank, and two handle fasteners.

31. The installed toilet assembly according to claim 27, wherein the toilet tank is sealingly installed on the toilet bowl.

32. The installed toilet assembly of claim 27, further comprising a wax seal on a lower surface of the toilet bowl and compressed between the upper surface of the flange and the lower surface of the toilet bowl.

33. The installed toilet assembly of claim 27, having a cover placed on the base of the toilet bowl over the bolt locking knob.

34. The method of claim 25, further comprising the bolt locking knob having an outer peripheral surface having a shape having curved depressions for manual tightening of the bolt locking knob.

35. A method for installing a two-piece toilet assembly on a mounting surface without using tools, comprising:

(a) providing a flange bolt comprising a bolt head and a bolt stem extending from the bolt head and having an end portion opposite the bolt head, wherein the stem has a length measured longitudinally along the stem and an outer surface;

(b) inserting the flange bolt through an opening in a flange, wherein the flange comprises an upper surface, a lower surface and the opening, wherein the opening extends from the upper surface to the lower surface and is configured to receive a flange bolt, so that the bolt head fits through the opening in the flange, the bolt head contacts the lower surface of the flange and the end portion of the stem extends upwardly from the upper surface of the flange and positioning the flange on a mounting surface;

(c) placing a toilet bowl having a mounting hole extending through a base thereof over the stem of the flange bolt so that the end portion of the stem extends upwardly through the mounting hole;

(d) placing a bolt locking knob over the end portion of the flange bolt stem, wherein the bolt locking knob has an interior surface defining an opening extending through the locking knob and an interior portion thereof, wherein the bolt locking knob is placed so that when the end portion of the bolt stem is within the opening of the bolt locking knob, the interior surface of the bolt locking knob contacts the exterior surface of the bolt stem in locking engagement and wherein the length of the bolt stem is pre-sized so that upon placement of a toilet bowl over the flange bolt and placement of the bolt locking knob over the end portion of the flange bolt stem, the end portion of the flange bolt stem is substantially within the opening of the bolt locking knob; and (e) fully tightening the knob manually on the bolt stem, (f) installing a tank over the toilet bowl, by (i) providing a handle fastener having a closed end and an interior surface defining an opening in the handle fastener, and an outer surface configured for manual tightening of the handle fastener;

(ii) placing a toilet tank having a tank bolt having an end extending downwardly therefrom over the toilet bowl so that the tank bolt extends downwardly through a tank mounting hole in a rear portion of an upper surface of the toilet bowl and the end of the tank bolt extends beyond the tank mounting hole;

(iii) inserting the end of the tank bolt in the opening of the handle fastener; and (iv) manually tightening the handle fastener on the tank bolt, wherein installation of the two-piece toilet assembly is completed without requiring use of tools.

36. The method according to claim 35, wherein there are two handle fasteners for receiving two tank locking bolts and the method further comprises manually tightening the two handle fasteners on the two tank bolts.

37. The method according to claim 35, wherein the interior surface of the handle fastener is threaded and the method further comprises manually tightening the handle fastener by engaging a threaded interior surface of the handle fastener with threads on an outer surface of the tank bolt.

38. The method according to claim 35, wherein the handle fastener has a detachable handle portion and the method further comprises detaching the handle portion.

39. The method according to claim 35, further comprising installing a toilet seat on the toilet bowl.

40. The method according to claim 39, wherein the toilet bowl has toilet seat mounting bolts installed thereon for receiving the toilet seat prior to placing the toilet bowl on the flange.

41. The method according to claim 40, wherein the toilet seat is capable of manually attaching to the toilet seat mounting bolts without use of tools.

42. A two-piece toilet assembled according to the method of claim 35.

43. A method for installing a toilet bowl on a mounting surface, comprising:

(a) providing a flange bolt comprising a bolt head and a bolt stem extending from the bolt head and having an end portion opposite the bolt head, wherein the stem has a length measured longitudinally along the stem and an outer surface;

(b) inserting the flange bolt through an opening in a flange, wherein the flange comprises an upper surface, a lower surface and the opening, wherein the opening extends from the upper surface to the lower surface and is configured to receive a flange bolt, so that the bolt head fits through the opening in the flange, and the end portion of the stem extends upwardly from the upper surface of the flange and positioning the flange on the mounting surface;

(c) positioning a mounting block on the mounting surface and positioning another mounting block on the mounting surface, wherein each of said mounting blocks is positioned so as to lie beneath a front and a rear portion of the lower surface of a toilet bowl when the toilet bowl is placed so as to be near or over the stem in step (d);

(d) placing the toilet bowl having a mounting hole extending through a base thereof so as to be near or over the stem of the flange bolt and lowering the toilet bowl until at least a portion of a lower surface of the toilet bowl rests on each mounting block;

(e) ensuring that the stem of the flange bolt is within the mounting hole and upright;

(f) removing the mounting blocks; and (g) placing a bolt locking knob over the end portion of the flange bolt stem, the bolt locking knob having an outer peripheral surface having a shape having curved depressions for manual tightening of the bolt locking knob.

44. The method according to claim 43, wherein step (e) further comprises moving the toilet bowl on the blocks until the stem of the flange bolt is within the mounting hole and upright.

45. The method according to claim 43, wherein each of the mounting blocks comprises a pull tab, and step (f) further comprises removing the mounting blocks by pulling the pull tab while lifting the toilet bowl.

46. The method according to claim 43, wherein each of said mounting blocks is formed of a material having sufficient strength for suspending a toilet during the installation and each mounting block is configured so that an installer can view and access the bolt stem for aligning the bolt stem when the toilet bowl is resting on the mounting blocks.

* * * * *